US011148416B2

(12) United States Patent
Kashimura et al.

(10) Patent No.: US 11,148,416 B2
(45) Date of Patent: Oct. 19, 2021

(54) LIQUID DISCHARGING APPARATUS AND CIRCUIT BOARD

(71) Applicant: SEIKO EPSON CORPORATION, Tokyo (JP)

(72) Inventors: Toru Kashimura, Shiojiri (JP); Dai Nozawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 14 days.

(21) Appl. No.: 16/724,517

(22) Filed: Dec. 23, 2019

(65) Prior Publication Data

US 2020/0198331 A1 Jun. 25, 2020

(30) Foreign Application Priority Data

Dec. 25, 2018 (JP) ..... JP2018-240839

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2002/14491* (2013.01)

(58) Field of Classification Search
CPC ..... B41J 2/04541; B41J 2/04588; B41J 2/04581; B41J 2002/14491; B41J 2/04593; B41J 2/04596
See application file for complete search history.

(56) References Cited

U.S. PATENT DOCUMENTS

2017/0100929 A1 4/2017 Nozawa
2018/0093473 A1* 4/2018 Yoshino ..... B41J 2/04588

FOREIGN PATENT DOCUMENTS

JP 09193381 A * 7/1997
JP 2017-071171 A 4/2017

OTHER PUBLICATIONS

IP.com search (Year: 2021).*
Saito, Asao, "Inkjet Head", Jul. 2, 1997, Machine Translation of JP 09193381 A, [Paragraphs 0033-0036. 0039-0044], (Year: 1997).*

* cited by examiner

*Primary Examiner* — Lisa Solomon
(74) *Attorney, Agent, or Firm* — Oliff PLC

(57) ABSTRACT

A liquid discharging apparatus that includes a discharging head for discharging liquid, a driving circuit for generating a driving signal, and a circuit board, in which the driving circuit includes a coil and a capacitor, the circuit board includes a first layer, a second layer, first wiring provided at the first layer, second wiring provided at the second layer, and interlayer wiring, the first wiring couples a first start point and a first end point, and is provided in a circumferential shape, the second wiring couples a second start point and a second end point, and is provided in a circumferential shape, the interlayer wiring electrically couples the first end point and the second start point, the first wiring and the second wiring partially overlap each other, and the first wiring, the second wiring, and the interlayer wiring constitute at least a part of the coil.

13 Claims, 15 Drawing Sheets

| | | LARGE DOT | MEDIUM DOT | SMALL DOT | MINUTE VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

LIQUID DISCHARGING APPARATUS AND CIRCUIT BOARD

The present application is based on, and claims priority from JP Application Serial Number 2018-240839, filed Dec. 25, 2018, the disclosure of which is hereby incorporated by reference herein in its entirety.

BACKGROUND

1. Technical Field

The present disclosure relates to a liquid discharging apparatus and a circuit board.

2. Related Art

An ink jet printer that prints an image or a document by discharging ink has been known in which a piezoelectric element is used. The piezoelectric element is provided corresponding to each of a plurality of nozzles in a head unit, and is driven in accordance with a driving signal, so that a predetermined amount of ink (liquid) is discharged at predetermined timing from a nozzle to form dots. Since the piezoelectric element is a capacitive load such as a capacitor in terms of electricity, it is necessary to supply a sufficient current to operate the piezoelectric element of each nozzle. Thus, a configuration is adopted in which a source signal is amplified by an amplifier circuit and supplied to the head unit as a driving signal, to drive the piezoelectric element.

JP-A-2017-071171 discloses a technique for generating a driving signal by applying a so-called class D amplifier circuit to a driving circuit for generating a driving signal, in which pulse width modulation or pulse density modulation is performed for a source signal, a high-side transistor and a low-side transistor serially inserted between power supply voltages are switched according to the modulation signal, and an amplified modulation signal by this switching is demodulated using a low pass filter including a coil and a capacitor to generate a driving signal to be supplied to a piezoelectric element.

However, in some cases, a component height of the coil constituting the class D amplifier circuit that is the driving circuit described in JP-A-2017-071171 becomes larger than component heights of other electronic components such as the high-side transistor, the low-side transistor, the capacitor, and the like. Then, when a circuit board on which a driving circuit is mounted in which the component height of the coil is larger than the component heights of other electronic components is disposed in a liquid discharging apparatus, there has been a possibility that space occupied by the circuit board in the liquid discharging apparatus increases, making it difficult to miniaturize the liquid discharging apparatus.

SUMMARY

An aspect of a liquid discharging apparatus according to the present disclosure includes a discharging head that includes a driving element configured to be driven by being supplied with a driving signal, and is configured to discharge liquid by the driving element being driven, a driving circuit configured to generate the driving signal, and a circuit board, in which the driving circuit includes a modulation circuit configured to generate a modulation signal obtained by performing pulse-modulation for a base driving signal serving as a base of the driving signal, an amplifier circuit configured to generate an amplified modulation signal obtained by amplifying the modulation signal, and a smoothing circuit including a coil and a capacitor, and configured to generate the driving signal obtained by smoothing the amplified modulation signal, the circuit board includes a first layer, a second layer, first wiring provided at the first layer, second wiring provided at the second layer, and interlayer wiring, the first wiring couples a first start point and a first end point, and is provided in a circumferential shape, the second wiring couples a second start point and a second end point, and is provided in a circumferential shape, the interlayer wiring electrically couples the first end point and the second start point, the first wiring and the second wiring partially overlap each other, in plan view of the circuit board from a direction orthogonal to the first layer, and the first wiring, the second wiring, and the interlayer wiring constitute at least a part of the coil.

In an aspect of the liquid discharging apparatus, a circumferential direction from the first start point toward the first end point of the first wiring, and a circumferential direction from the second start point toward the second end point of the second wiring may be identical directions.

In an aspect of the liquid discharging apparatus, the circuit board includes third wiring provided at the first layer, and fourth wiring provided at the second layer, the third wiring couples the first end point and the interlayer wiring, and may extend outward the first wiring, and the fourth wiring couples the second start point and the interlayer wiring, and may extend outward the second wiring.

In an aspect of the liquid discharging apparatus, in the plan view, the third wiring and the fourth wiring may be provided so as to partially overlap each other.

In an aspect of the liquid discharging apparatus, the third wiring and the fourth wiring may be coupled to each other with plural pieces of interlayer wiring included by the circuit board.

In an aspect of the liquid discharging apparatus, the first wiring may be circular wiring.

In an aspect of the liquid discharging apparatus, a magnetic body may be provided in an area inside the first wiring.

In an aspect of the liquid discharging apparatus, in the plan view, at least a part of the magnetic body may overlap with the first wiring.

An aspect of a circuit board according to the present disclosure includes a first layer, a second layer, first wiring provided at the first layer, second wiring provided at the second layer, third wiring provided at the first layer, fourth wiring provided at the second layer, and interlayer wiring, in which the first wiring couples a first start point and a first end point, and is provided in a circumferential shape, the second wiring couples a second start point and a second end point, and is provided in a circumferential shape, the third wiring couples the first end point and the interlayer wiring, and extends outward the first wiring, the fourth wiring couples the second start point and the interlayer wiring, and extends outward the second wiring, the interlayer wiring electrically couples the first end point and the second start point, the first wiring and the second wiring partially overlap each other in plan view from a direction orthogonal to the first layer, and the first wiring, the second wiring, and the interlayer wiring constitute at least a part of a coil.

In an aspect of the circuit board, a circumferential direction from the first start point toward the first end point of the first wiring, and a circumferential direction from the second start point toward the second end point of the second wiring may be identical directions.

In an aspect of the circuit board, in the plan view, the third wiring and the fourth wiring may be provided so as to partially overlap each other.

In an aspect of the circuit board, the third wiring and the fourth wiring may be coupled to each other with plural pieces of interlayer wiring included by the circuit board.

In an aspect of the circuit board, the first wiring may be provided in a circular shape.

DESCRIPTION OF EXEMPLARY EMBODIMENTS

A preferred exemplary embodiment of the present disclosure will be described below with reference to the accompanying drawings. The drawings to be used are for convenience of description. Note that, the exemplary embodiment described below is not intended to limit contents of the present disclosure described in the claims in an unauthorized manner. Moreover, all of configurations described below do not necessarily include essential constituent elements of the present disclosure.

1. Overview of Liquid Discharging Apparatus

Figure 1:
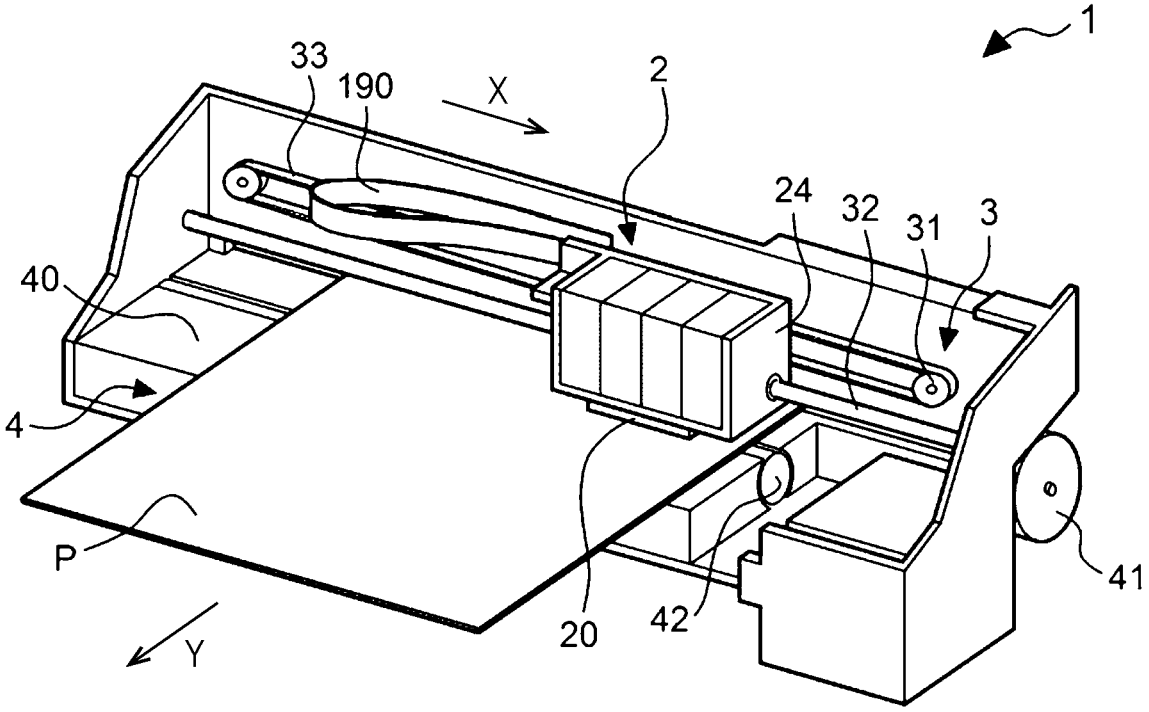
FIG. 1 is a perspective view illustrating a schematic configuration of an inside of a liquid discharging apparatus.

FIG. 1 is a perspective view illustrating a schematic configuration of an inside of a liquid discharging apparatus 1. As illustrated in FIG. 1, the liquid discharging apparatus 1 includes a moving mechanism 3 for reciprocating a moving body 2 in a direction along a main scanning direction X.

The moving mechanism 3 includes a carriage motor 31 serving as a driving source of the moving body 2, a carriage guide shaft 32 with both ends thereof fixed, and a timing belt 33 extending substantially parallel to the carriage guide shaft 32, and driven by the carriage motor 31.

The moving body 2 has a carriage 24. The carriage 24 is reciprocably supported by the carriage guide shaft 32, and is fixed to a part of the timing belt 33. Thus, by the carriage motor 31 driving the timing belt 33 forward and backward, the moving body 2 is guided by the carriage guide shaft 32 and reciprocates. Further, a head unit 20 is provided on a portion of the moving body 2 opposed to a medium P. As will be described later, the head unit 20 includes a plurality of nozzles for discharging ink as liquid. Further, various control signals and the like are supplied to the head unit 20 via a flexible cable 190.

The liquid discharging apparatus 1 includes a transport mechanism 4 for transporting the medium P on a platen 40 in a direction along a sub-scanning direction Y. The transport mechanism 4 includes a transport motor 41 serving as a driving source, and a transport roller 42 rotated by the transport motor 41, and transporting the medium P in the sub-scanning direction Y.

In the liquid discharging apparatus 1 constituted as described above, by the head unit 20 discharging ink to the medium P at timing at which the medium P is transported by the transport mechanism 4, a desired image is formed on a surface of the medium P.

Figure 2:
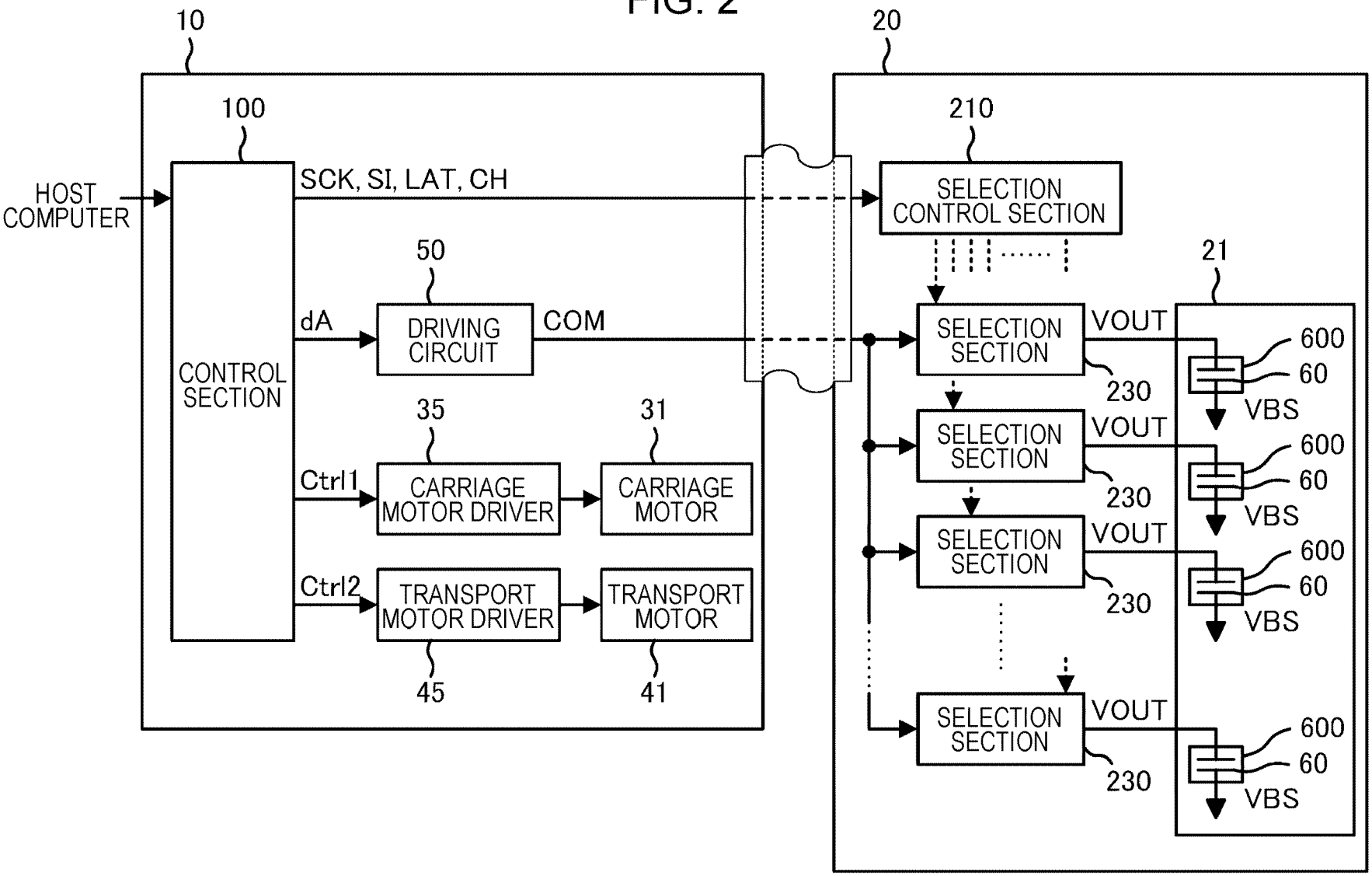
FIG. 2 is a block diagram illustrating an electrical configuration of the liquid discharging apparatus.

FIG. 2 is a block diagram illustrating an electrical configuration of the liquid discharging apparatus 1. As illustrated in FIG. 2, the liquid discharging apparatus 1 includes a control unit 10, the head unit 20, and the flexible cable 190 electrically coupling the control unit 10 and the head unit 20.

The control unit 10 includes a control section 100, the carriage motor 31, a carriage motor driver 35, the transport motor 41, a transport motor driver 45, and a driving circuit 50.

When image data is supplied from a host computer, the control section 100 outputs various control signals and the like for controlling each section. Specifically, the control section 100 outputs a control signal Ctr1 to the carriage motor driver 35. The carriage motor driver 35 drives the carriage motor 31 in accordance with the control signal Ctr1. Thus, movement of the carriage 24 along the main scanning direction X by the moving mechanism 3 is controlled.

Further, the control section 100 outputs a control signal Ctr2 to the transport motor driver 45. The transport motor driver 45 drives the transport motor 41 in accordance with the control signal Ctr2. Thus, movement of the medium P along the sub-scanning direction Y by the transport mechanism 4 is controlled.

Further, the control section 100 outputs a base driving signal dA that is digital data to the driving circuit 50. Here, the base driving signal dA is data that defines a waveform of a driving signal COM supplied to the head unit 20. The driving circuit 50 performs analog conversion for the base driving signal dA, and then performs class D amplification to generate the driving signal COM, to supply to the head unit 20. Note that, details of the driving circuit 50 will be described later.

Also, the control section 100 outputs a clock signal SCK, a print signal SI, a latch signal LAT, and a change signal CH to the head unit 20.

The head unit 20 includes a selection control section 210, a plurality of selection sections 230, and a discharging head 21. Further, the discharging head 21 includes a plurality of discharging sections 600 including piezoelectric elements 60. Here, each of the plurality of selection sections 230 is provided corresponding to the piezoelectric element 60 included in each of the plurality of discharging sections 600 included in the discharging head 21.

The selection control section 210 instructs each of the selection sections 230 to select or not to select the driving signal COM, based on a control signal or the like supplied from the control section 100. The selection section 230, by selecting or not selecting the driving signal COM according to the instruction by the selection control section 210, generates a driving signal VOUT to supply to one end of the corresponding piezoelectric element 60. In addition, a reference voltage signal VBS is supplied to another end of the piezoelectric elements 60 in common.

The piezoelectric element 60 is provided corresponding to each of the plurality of nozzles in the head unit 20. In addition, the piezoelectric element 60 is driven in accordance with a potential difference between the driving signal VOUT supplied to the one end, and the reference voltage signal VBS supplied to the other end, whereby ink is discharged from the corresponding nozzle.

Note that, in FIG. 2, only one discharging head 21 is illustrated, but the head unit 20 may have the plurality of the discharging heads 21 in accordance with ink colors to be discharged.

2. Configuration and Operation of Head Unit 20

Figure 3:
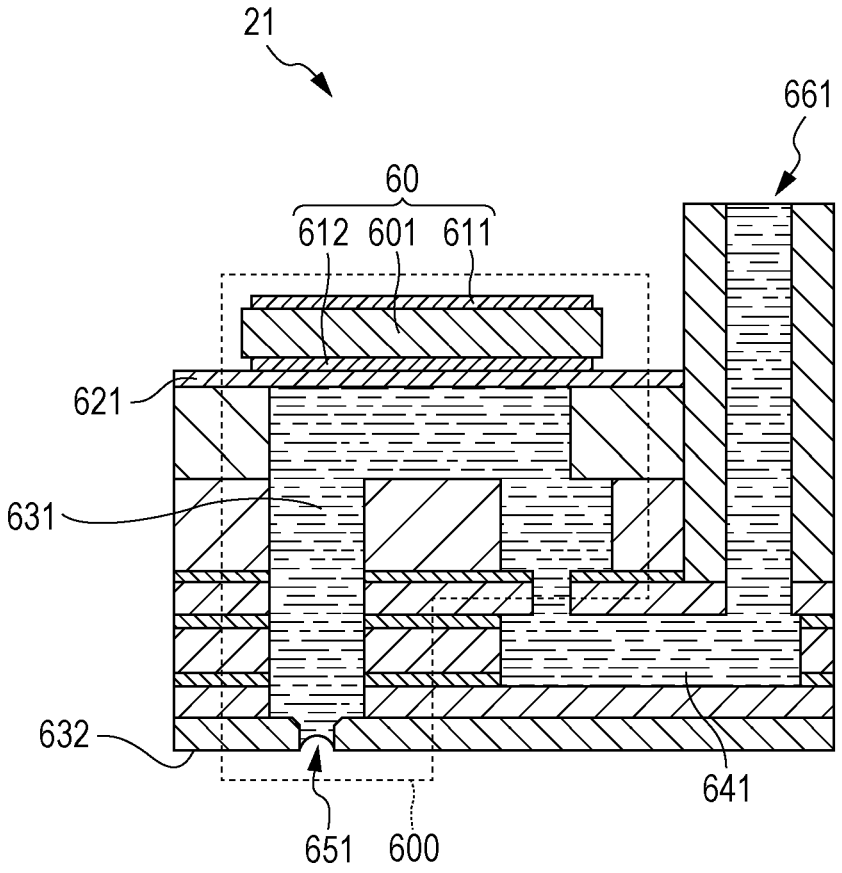
FIG. 3 is a sectional view illustrating a schematic configuration of a discharging section.

Here, a configuration and operation of the head unit 20 will be described specifically. First, a configuration and operation of the discharging section 600 included in the discharging head 21 included in the head unit 20 will be described. FIG. 3 is a sectional view illustrating a schematic configuration of the discharging section 600. As illustrated in FIG. 3, the discharging head 21 includes the discharging section 600 and a reservoir 641.

Ink is supplied from a supply port 661 into the reservoir 641. Further, the reservoir 641 is provided for each color of ink.

The discharging section 600 includes the piezoelectric element 60, a vibrating plate 621, a cavity 631, and a nozzle 651. The cavity 631, with ink filling inside thereof, functions as a pressure chamber in which an inner volume changes due to displacement of the piezoelectric element 60. The vibrating plate 621 is provided between the cavity 631 and the piezoelectric element 60. In addition, the vibrating plate 621 functions as a diaphragm that expands and reduces the inner volume of the cavity 631 filled with the ink, by being displaced according to the driving of the piezoelectric element 60. The nozzle 651 is an opening section provided in the nozzle plate 632, and communicates with the cavity 631. In addition, the nozzle 651 discharges the ink filled in the cavity 631 in accordance with the change in the inner volume of the cavity 631.

The piezoelectric element 60 has structure in which a piezoelectric body 601 is sandwiched between a pair of electrodes 611 and 612. The driving signal VOUT is supplied to the electrode 611, and the reference voltage signal VBS is supplied to the electrode 612. Here, the reference voltage signal VBS supplied to the electrode 612 is a voltage signal having a constant potential, and is, for example, a ground signal having a ground potential or a DC voltage signal such as DC 5 V. The piezoelectric element 60 configured as described above is driven up and down in accordance with a potential difference between the electrode 611 and the electrode 612. Accordingly, a center portion of each of the electrodes 611, 612 and the vibrating plate 621 is displaced in a vertical direction against both end portions. Then, the ink is discharged from the nozzle 651 in accordance with the displacement of the vibrating plate 621. That is, the discharging head 21 includes the piezoelectric element 60 driven by being supplied with the driving signal VOUT, and the piezoelectric element 60 is driven to discharge the ink from the nozzle 651. Here, the piezoelectric element 60 is an example of a driving element, and the driving signal VOUT for driving the piezoelectric element 60 is an example of a driving signal. Further, as will be described later in detail, the driving signal VOUT is generated by selecting or not selecting a voltage waveform of the driving signal COM. Thus, in a broad sense, the driving signal COM is also an example of the driving signal.

Figure 4:
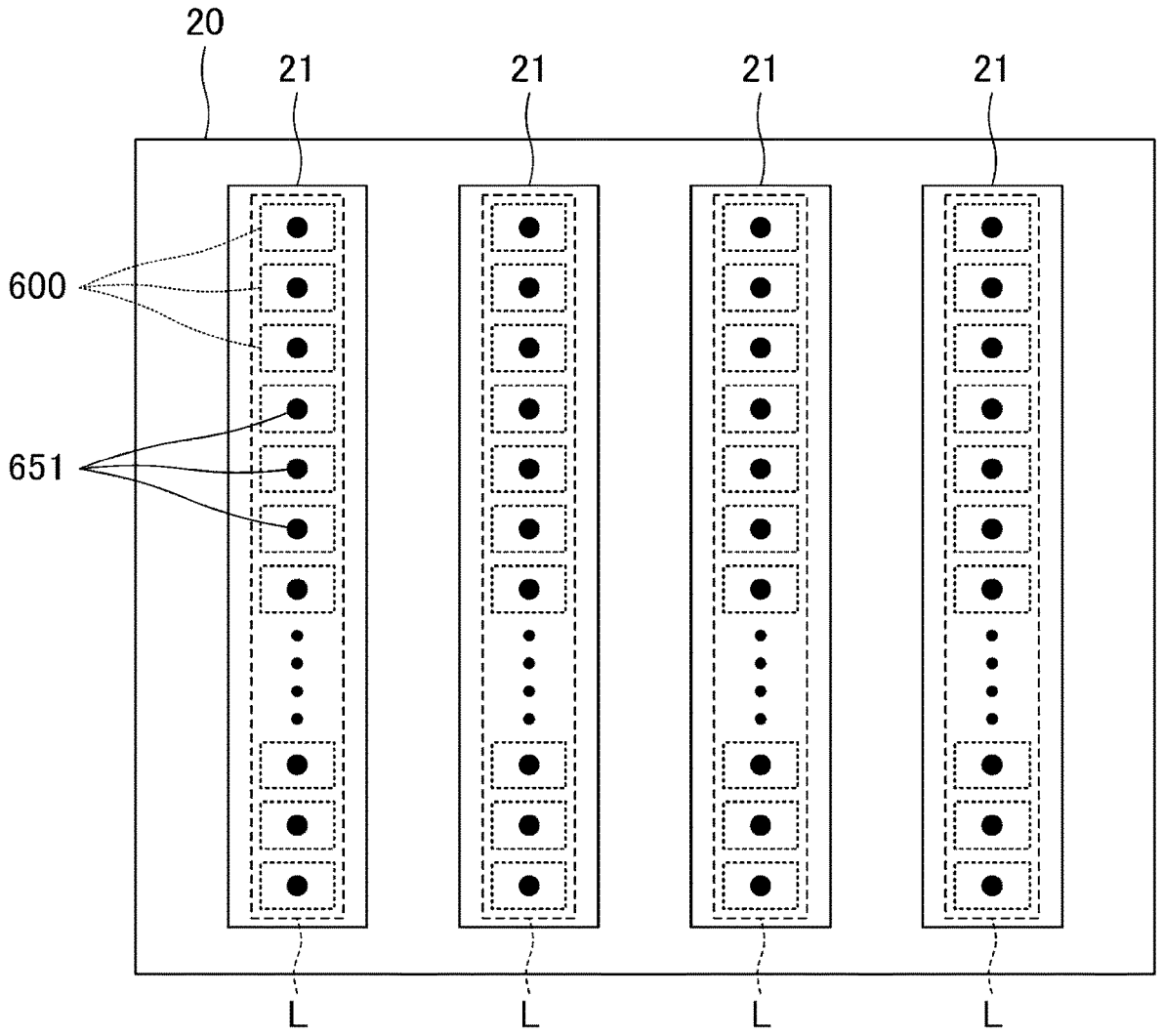
FIG. 4 is a diagram illustrating an example of arrangement of a plurality of nozzles.

FIG. 4 is a diagram illustrating an example of arrangement of the plurality of nozzles 651 provided in the discharging head 21. Note that, FIG. 4 illustrates a case in which four discharging heads 21 are provided in the head unit 20.

As illustrated in FIG. 4, nozzle rows L each formed of the plurality of nozzles 651 provided in a row in a predetermined direction are formed in the discharging head 21. Each of the nozzle rows L is formed of n nozzles 651 arranged in a row. Note that, the arrangement of the nozzle rows L illustrated in FIG. 4 is an example, and for example, the n nozzles 651 may be arranged in a zigzag so that the even-numbered nozzles 651 and the odd-numbered nozzles 651 counted from an end have different positions each other, in each of the nozzle rows L. Further, "two" or more nozzle rows L may be formed in each of the discharging heads 21.

Next, a configuration and operation of the selection control section 210 and the selection sections 230 will be described. As described above, the selection control section 210 instructs each of the selection sections 230 to select or not to select the driving signal COM, and the selection section 230 selects or does not select the driving signal COM according to the instruction. Thus, an example of the waveform of the driving signal COM generated by the driving circuit 50 will be described with reference to FIG. 5, and then the configuration and operation of the selection control section 210 and the selection section 230 will be described with reference to FIG. 6 to FIG. 9.

Figure 5:
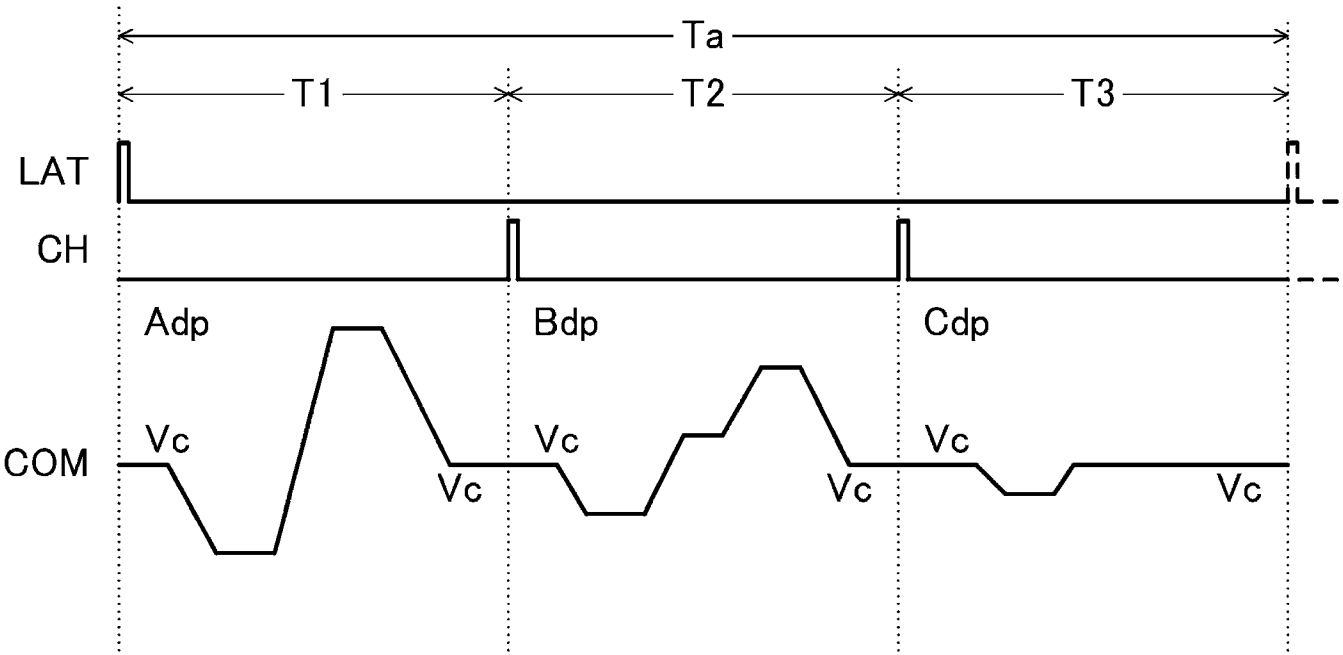
FIG. 5 is a diagram illustrating an example of a waveform of a driving signal COM.

FIG. 5 is a diagram illustrating an example of the waveform of the driving signal COM. FIG. 5 illustrates a period T1 from rise of the latch signal LAT to rise of the change signal CH, a period T2 after the period T1 until next rise of the change signal CH, and a period T3 after the period T2 until rise of the latch signal LAT. Note that, a cycle configured by the periods T1, T2, and T3 is a cycle Ta for forming a new dot on the medium P.

As illustrated in FIG. 5, the driving circuit 50 generates a voltage waveform Adp in the period T1. When the voltage waveform Adp is supplied to the piezoelectric element 60, a predetermined amount, specifically a medium amount of ink, is discharged from the corresponding discharging section 600. Further, the driving circuit 50 generates a voltage waveform Bdp in the period T2. When the voltage waveform Bdp is supplied to the piezoelectric element 60, a small amount of ink smaller than the above mentioned predetermined amount is discharged from the corresponding discharging section 600. Further, the driving circuit 50 generates a voltage waveform Cdp in the period T3. When the voltage waveform Cdp is supplied to the piezoelectric element 60, the piezoelectric element 60 is driven to such an extent that ink is not discharged from the corresponding discharging section 600. Thus, when the voltage waveform Cdp is supplied to the piezoelectric element 60, dots are not formed on the medium P. This voltage waveform Cdp is a waveform for preventing viscosity of ink from increasing by minutely vibrating the ink in a vicinity of a nozzle opening portion of the discharging section 600. Note that, in the following description, driving the piezoelectric element 60 to the extent that the ink is not discharged from the nozzle 651, in order to prevent the viscosity of ink from increasing, is referred to as "minute vibration" in some cases.

Here, voltage values at start timing and voltage values at end timing of the voltage waveform Adp, the voltage waveform Bdp, and the voltage waveform Cdp are all commonly a voltage Vc. That is, the voltage waveforms Adp, Bdp, and Cdp are waveforms for which a voltage value starts at the voltage Vc and ends at the voltage Vc. Thus, the driving circuit 50 outputs the driving signal COM having a waveform in which the voltage waveforms Adp, Bdp, and Cdp are continuous in the cycle Ta.

Figure 6:
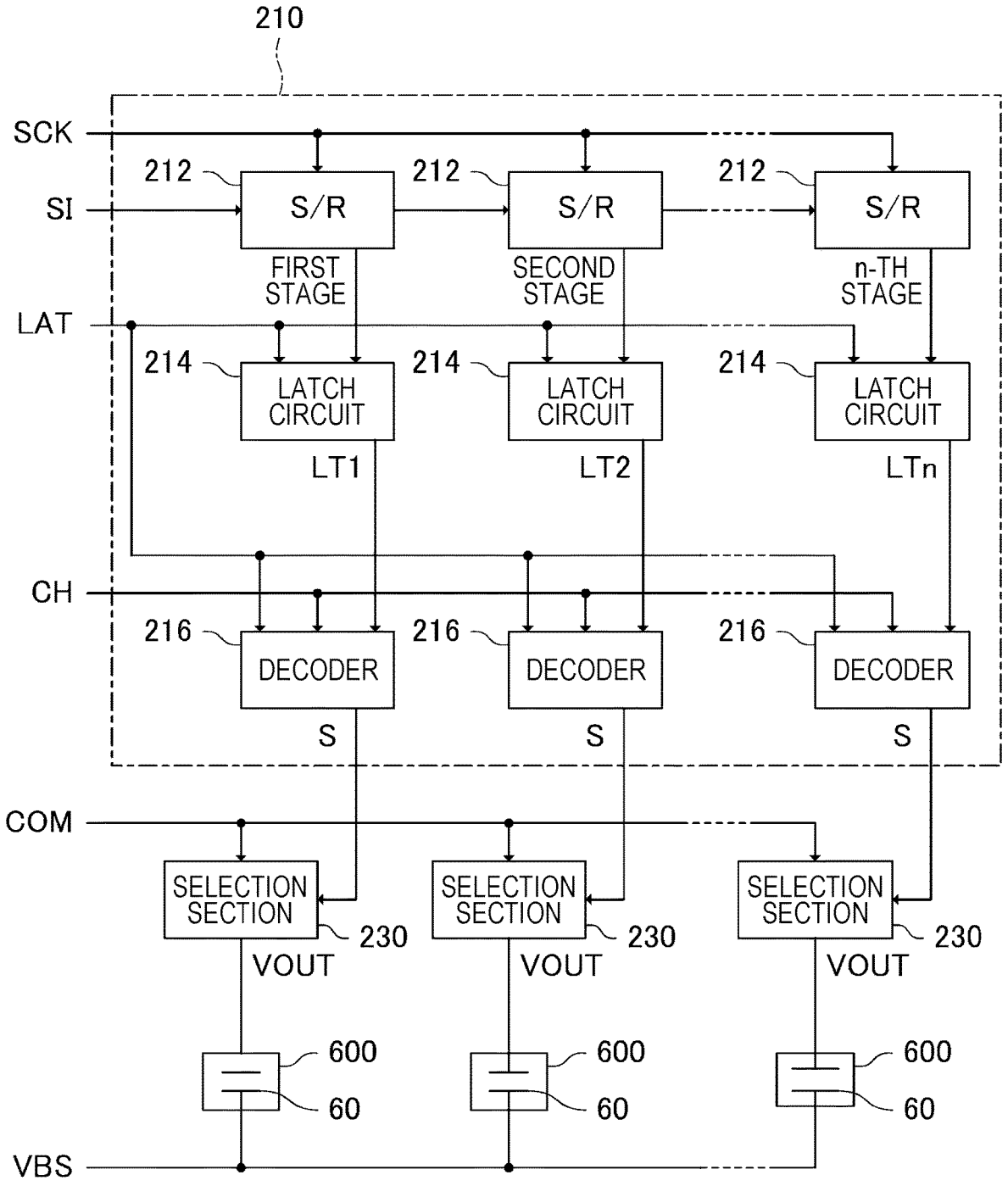
FIG. 6 is a diagram illustrating a configuration of a selection control section and selection sections.

FIG. 6 is a diagram illustrating the configuration of the selection control section 210 and the selection sections 230. The selection control section 210 generates a selection signal S for controlling whether or not to select the voltage waveforms Adp, Bdp, and Cdp included in the driving signal COM in the periods T1, T2, and T3, respectively. Then, based on the selection signal S, the selection section 230 switches whether or not to select the voltage waveforms Adp, Bdp, and Cdp included in the driving signal COM, to output as the drive signal VOUT.

The selection control section 210 is supplied with the clock signal SCK, the print signal SI, the latch signal LAT, and the change signal CH. In the selection control section 210, a set of a shift register 212 (S/R), a latch circuit 214, and a decoder 216, is provided corresponding to each of the discharging sections 600. That is, the head unit 20 is provided with the same number of sets of the shift register 212, the latch circuit 214, and the decoder 216, as a total number n of the discharging sections 600.

The shift register 212 temporarily holds two-bit print data [SIH, SIL] included in the print signal SI for each of the corresponding discharging sections 600. Specifically, the same stage number of shift registers 212 corresponding to the discharging sections 600 are cascade-coupled, and the print signals SI supplied serially are sequentially transferred to subsequent stages in accordance with the clock signal SCK. Note that, in FIG. 6, in order to distinguish the shift registers 212 from each other, the stages are denoted as a first stage, second stage, . . . , n-th stage in order from upstream to which the print signal SI is supplied.

Each of n latch circuits 214 latches the print data [SIH, SIL] held in the corresponding shift register 212 at rising of the latch signal LAT. Each of n decoders 216 decodes the two-bit print data [SIH, SIL] latched by the corresponding latch circuit 214 to generate the selection signal S.

The selection section 230 is provided corresponding to each of the discharging sections 600. That is, the number of the selection sections 230 included in the head unit 20 is the same as the total number n of the discharging sections 600 included in the head unit 20. The selection signal S is inputted to the selection section 230 from the decoder 216. Based on the selection signal S, the selection section 230, by selecting or not selecting the driving signal COM, generates the driving signal VOUT to supply to the piezoelectric element 60.

Figures 7, 8:
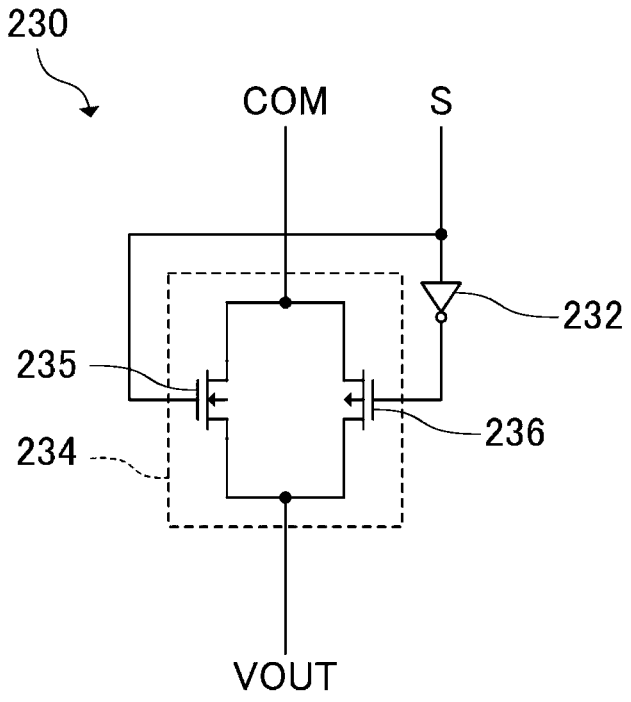
FIG. 7 is a circuit diagram illustrating an electric configuration of the selection section.
FIG. 8 is a diagram illustrating decoding contents in a decoder.

FIG. 7 is a circuit diagram illustrating an electric configuration of the selection section 230 corresponding to one discharging section 600. As illustrated in FIG. 7, the selection section 230 includes an inverter 232 and a transfer gate 234. Further, the transfer gate 234 includes a transistor 235 that is an NMOS transistor, and a transistor 236 that is a PMOS transistor.

The selection signal S is supplied from the decoder 216 to a gate terminal of the transistor 235. Further, the selection signal S is logically inverted by the inverter 232, and is also supplied to a gate terminal of the transistor 236. The driving signal COM is inputted to a drain terminal of the transistor 235 and a source terminal of the transistor 236. Then, the transistor 235 and the transistor 236 are controlled to be turned on or off according to the selection signal S, so that the driving signal VOUT is outputted from a coupling point at which a source terminal of the transistor 235 and a drain terminal of the transistor 236 are coupled in common.

Next, decoding contents in the decoder 216 will be described with reference to FIG. 8. FIG. 8 is a diagram illustrating the decoding contents in the decoder 216. The two-bit print data [SIH, SIL], the latch signal LAT, and the change signal CH are inputted to the decoder 216. Then, the decoder 216 outputs the selection signal S at a logic level defined by the print data [SIH, SIL] for each of the periods T1, T2, and T3 defined by the latch signal LAT and the change signal CH. For example, when [1, 0] is inputted as the print data [SIH, SIL] to the decoder 216, the decoder 216 outputs the selection signal S that is set to H, L, and L levels in the periods T1, T2, and T3, respectively. Note that, the logic level of the selection signal S is level-shifted to a high amplitude logic signal by a level shifter (not illustrated).

Operation in which the driving signal VOUT based on the driving signal COM is generated in the selection control section 210 and the selection section 230 described above will be described with reference to FIG. 9.

Figure 9:
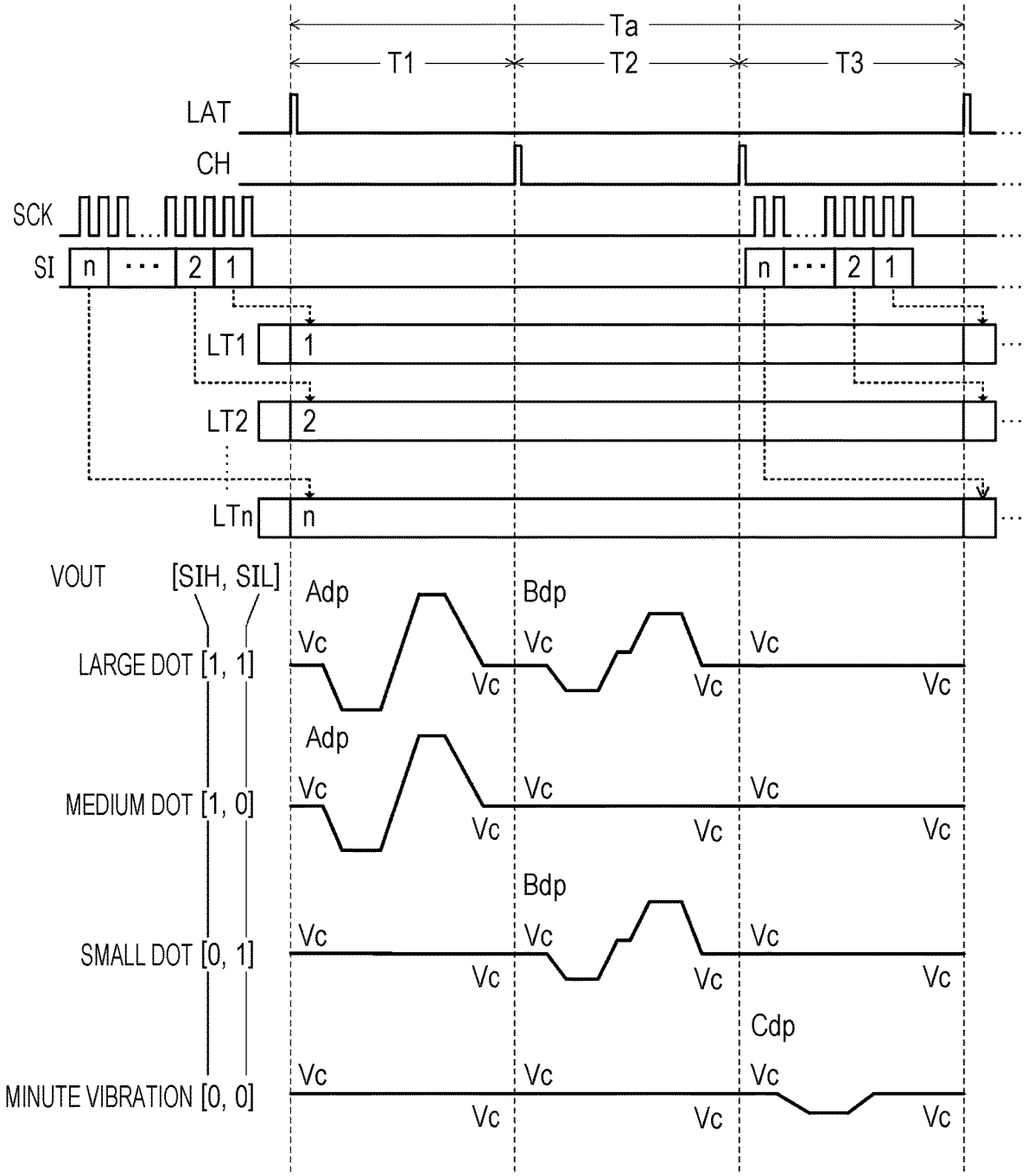
FIG. 9 is a diagram for explaining operation of the selection control section and the selection section.

FIG. 9 is a diagram for explaining the operation of the selection control section 210 and the selection section 230. As illustrated in FIG. 9, the print signal SI is serially supplied to the selection control section 210 in synchronization with the clock signal SCK, and is sequentially transferred in the shift register 212 corresponding to the discharging sections 600. Additionally, when the supply of the clock signal SCK is stopped, the print data [SIH, SIL] corresponding to each of the discharging sections 600 is held in each of the shift registers 212. Note that, the print signal SI is supplied in an order corresponding to the respective discharging sections 600 in the last n-th stage, . . . , second stage, and first stage, in the shift registers 212.

Further, when the latch signal LAT rises, each of the latch circuits 214 latches the print data [SIH, SIL] held in the corresponding shift register 212 at the same time. Note that, in FIG. 9, LT1, LT2, . . . , LTn denote the print data [SIH, SIL] latched by the latch circuits 214 corresponding to the respective shift registers 212 in the first stage, second stage, . . . , n-th stage.

The decoder 216 outputs the selection signal S at a logic level according to contents illustrated in FIG. 8 in each of the periods T1, T2, and T3, in accordance with a size of a dot defined by the latched print data [SIH, SIL].

When the print data [SIH, SIL] is [1, 1], the selection section 230, in accordance with the selection signal S, selects the voltage waveform Adp in the period T1, selects the voltage waveform Bdp in the period T2, and does not select the voltage waveform Cdp in the period T3. As a result, the driving signal VOUT corresponding to a large dot illustrated in FIG. 9 is generated. Accordingly, a medium amount of ink and a small amount of the ink are discharged from the discharging section 600 in the cycle Ta. Accordingly, the "large dot" is formed on the medium P.

Further, when the print data [SIH, SIL] is [1, 0], the selection section 230, in accordance with the selection signal S, selects the voltage waveform Adp in the period T1, does not select the voltage waveform Bdp in the period T2, and does not select the voltage waveform Cdp in the period T3. As a result, the driving signal VOUT corresponding to a medium dot illustrated in FIG. 9 is generated. Accordingly, a medium amount of the ink is discharged from the discharging section 600 in the cycle Ta. Accordingly, the "medium dot" is formed on the medium P.

Further, when the print data [SIH, SIL] is [0, 1], the selection section 230, in accordance with the selection signal S, does not select the voltage waveform Adp in the period T1, selects the voltage waveform Bdp in the period T2, and does not select the voltage waveform Cdp in the period T3. As a result, the driving signal VOUT corresponding to a small dot illustrated in FIG. 9 is generated. Accordingly, a small amount of the ink is discharged from the discharging section 600 in the cycle Ta. Accordingly, the "small dot" is formed on the medium P.

Further, when the print data [SIH, SIL] is [0, 0], the selection section 230, in accordance with the selection signal S, does not select the voltage waveform Adp in the period T1, does not select the voltage waveform Bdp in the period T2, and selects the voltage waveform Cdp in the period T3. As a result, the driving signal VOUT corresponding to minute vibration illustrated in FIG. 9 is generated. Thus, the ink is not discharged from the discharging section 600 in the cycle Ta, and the minute vibration is performed. In this case, no dots are formed on the medium P.

The selection control section 210 and the plurality of selection sections 230 configured as described above may be configured by one integrated circuit (IC). In addition, when the head unit 20 includes the plurality of discharging heads 21, the selection control section 210 and a plurality of the selection sections 230 may be provided for each of the plurality of discharging heads 21.

3. Configuration of Driving Circuit

Figure 10:
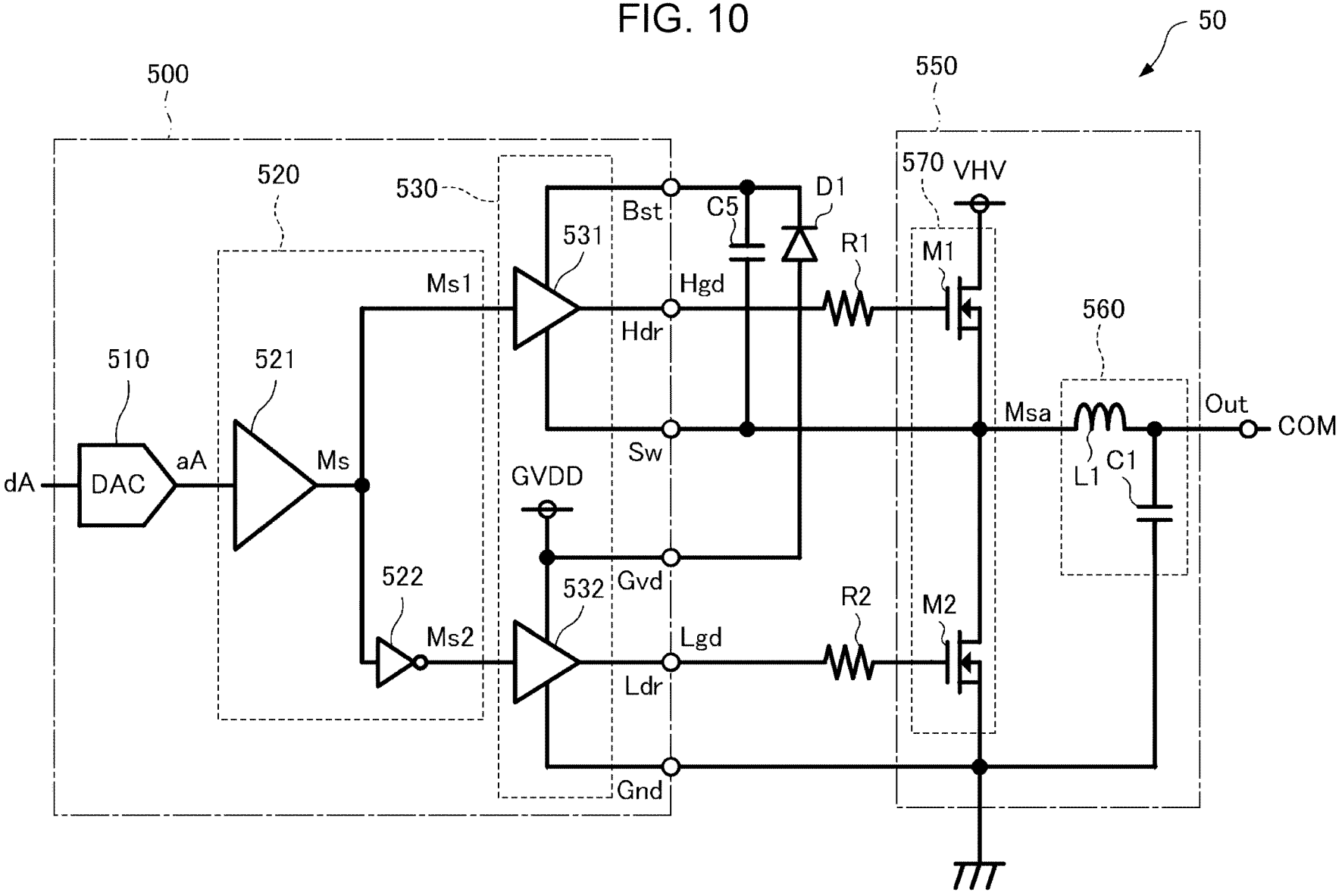
FIG. 10 is a diagram illustrating a configuration of a driving circuit.

Next, a configuration and operation of the driving circuit 50 for generating the driving signal COM will be described. FIG. 10 is a diagram illustrating the configuration of the driving circuit 50. The driving circuit 50 includes a modulation circuit 520 for generating a modulation signal Ms obtained by performing pulse-modulation for the base driving signal dA serving as a base of the driving signal COM, an amplifier circuit 570 for generating an amplified modulation signal Msa obtained by amplifying the modulation signal Ms, and a smoothing circuit 560 including a coil L1 and a capacitor C1 and generating the driving signal COM obtained by smoothing the amplified modulation signal Msa.

As illustrated in FIG. 10, the driving circuit 50 includes an integrated circuit 500, an output circuit 550, and a plurality of circuit elements. The integrated circuit 500 outputs gate driving signals Hgd and Lgd for driving transistors M1 and M2 included in the amplifier circuit 570 in the output circuit 550, based on the inputted base driving signal dA. The integrated circuit 500 includes a Digital to Analog Converter (DAC) 510, the modulation circuit 520, and a gate drive circuit 530.

The base driving signal dA is inputted to the DAC 510. The DAC 510 performs digital-to-analog conversion for the base driving signal dA to generate a base driving signal aA being an analog signal. A signal obtained by amplifying a voltage of the base driving signal aA is the driving signal COM. That is, the base driving signal aA is a target signal before the driving signal COM defined by the base driving signal dA being a digital signal is amplified, and each of the base driving signal dA being the digital signal and the base driving signal aA being the analog signal is an example of the base driving signal that is the basis of the driving signal COM.

The modulation circuit 520 includes a comparator 521 and an inverter 522. The base driving signal aA is inputted to the comparator 521. The comparator 521 outputs the modulation signal Ms that is set to the H level when a voltage value of the base driving signal aA rises and reaches or exceeds a predetermined voltage threshold Vth1, and is set to the L level when the voltage value of the base driving signal aA declines and falls below a predetermined voltage threshold Vth2.

The modulation signal Ms outputted from the comparator 521 is divided in the modulation circuit 520. The modulation signal Ms on one branch is outputted to the gate drive circuit 530 as a modulation signal Ms1. In addition, the modulation signal Ms on another branch is outputted to the gate drive circuit 530 as a modulation signal Ms2 via the inverter 522. That is, the modulation circuit 520 generates two types of the modulation signals Ms1 and Ms2 at respective exclusive logic levels, to output to the gate drive circuit 530. Here, the two types of signals at the respective exclusive logic levels include signals for which timing is controlled by a delay circuit or the like not illustrated in the figure, so that the logic levels of the respective signals are not set to the H level at the same time. In addition, although the modulation signals referred to here, in a narrow sense, are the modulation signals Ms and Ms1, assuming that the base driving signals dA and aA are pulse-modulated, the modulation signal Ms2 that is a negative signal of the modulation signal Ms, is also an example of a modulation signal.

The gate drive circuit 530 includes gate drivers 531 and 532. The gate driver 531 generates the gate driving signal Hgd by level-shifting a voltage value of the modulation signal Ms1 outputted from the modulation circuit 520, to output from a terminal Hdr. Specifically, of power supply voltages of the gate driver 531, a voltage is supplied to a high potential side via a terminal Bst, and a voltage is supplied to a low potential side via a terminal Sw. The terminal Bst is coupled in common to one end of a capacitor C5 provided outside the integrated circuit 500 and a cathode terminal of a diode Dl for preventing backflow. Further, another end of the capacitor C5 is coupled to the terminal Sw. Further, an anode terminal of the diode Dl is coupled to a terminal Gvd. Then, a voltage GVDD having the above-described predetermined voltage value is supplied to the terminal Gvd. Thus, a potential difference between the terminal Bst and the terminal Sw approximately equals a potential difference between both the ends of the capacitor C5, that is, the voltage GVDD. In addition, the gate driver 531 generates, in accordance with the inputted modulation signal Ms1, the gate driving signal Hgd having a voltage value larger than the terminal Sw by the voltage GVDD, to output from the terminal Hdr.

The gate driver 532 operates on a lower potential side than the gate driver 531. The gate driver 532 generates the gate driving signal Lgd by level-shifting a voltage value of the modulation signal Ms2 outputted from the modulation circuit 520, to output from a terminal Ldr. Specifically, of power supply voltages of the gate driver 532, the voltage GVDD is supplied to a high potential side, and the ground signal is supplied to a low potential side. In addition, the gate driver 532 generates, in accordance with the inputted modulation signal Ms2, the gate driving signal Lgd having a voltage value larger than a terminal Gnd by the voltage GVDD, to output from the terminal Ldr.

Here, the voltage value of the voltage GVDD is a voltage value larger than gate drive threshold voltages for the transistors M1 and M2 included in the amplifier circuit 570 described later, and is set to, for example, DC 7.5 V or the like.

The output circuit 550 includes the amplifier circuit 570 and the smoothing circuit 560. Further, the amplifier circuit 570 includes the transistors M1 and M2. Note that, each of the transistors M1 and M2 illustrated in FIG. 10 may be, for example, a surface mount type N-channel type Field Effect Transistor (FET).

A voltage VHV is supplied to a drain electrode of the transistor M1. Further, a gate electrode of the transistor M1 is coupled to one end of a resistor R1. In addition, another end of the resistor R1 is coupled to the terminal Hdr. Further, a source electrode of the transistor M1 is coupled to the terminal Sw. The transistor M1 coupled as described above operates in accordance with the gate driving signal Hgd outputted from the terminal Hdr.

A drain electrode of the transistor M2 is coupled to the source electrode of the transistor M1. Further, a gate electrode of the transistor M2 is coupled to one end of the resistor R2. In addition, another end of the resistor R2 is coupled to the terminal Ldr. Further, the ground signal is supplied to a source electrode of the transistor M2. The transistor M2 coupled as described above operates in accordance with the gate driving signal Lgd outputted from the terminal Ldr.

In the amplifier circuit 570 configured as described above, when the transistor M1 is controlled to be turned off and the transistor M2 is controlled to be turned on, a coupling point to which the terminal Sw is coupled is set to the ground potential. Thus, the voltage GVDD is supplied to the terminal Bst. On the other hand, when the transistor M1 is controlled to be turned on and the transistor M2 is controlled to be turned off, the voltage VHV is supplied to the coupling point to which the terminal Sw is coupled. Thus, a voltage (VHV+GVDD) is supplied to the terminal Bst.

Here, the gate driver 531 drives the transistor M1 using the capacitor C5 as a floating power supply. In addition, in accordance with the operation of the transistors M1 and M2, the voltage at the terminal Sw to which the one end of the capacitor C5 is coupled changes to the ground potential or the voltage VHV, thus the gate driver 531 generates the gate driving signal Hgd for which the L level is the voltage VHV and the H level is the voltage (VHV+GVDD), to supply to the gate electrode of the transistor M1. The transistor M1 performs a switching operation based on the gate driving signal Hgd supplied to the gate electrode. Further, the gate driver 532 for driving the transistor M2 generates the gate driving signal Lgd for which the L level is the ground potential and the H level is the voltage GVDD, irrespective of the operation of the transistors M1 and M2, to supply to the gate electrode of the transistor M2. The transistor M2 performs a switching operation based on the gate driving signal Lgd supplied to the gate electrode.

Accordingly, the amplified modulation signal Msa obtained by amplifying the modulation signal Ms based on the voltage VHV is generated at a coupling point between the source electrode of the transistor M1 and the drain electrode of the transistor M2. Here, the voltage VHV is a voltage serving as a reference of a maximum voltage of the driving signal COM generated by the driving circuit 50, and is set to, for example, DC 42 V.

The smoothing circuit 560 includes the coil L1 and the capacitor C1. One end of the coil L1 is coupled in common to the source electrode of the transistor M1 and the drain electrode of the transistor M2. Further, another end of the coil L1 is coupled in common to a terminal Out from which the driving signal COM is outputted and one end of the capacitor C1. Further, the ground signal is supplied to another end of the capacitor C1. That is, the smoothing circuit 560 forms a low-pass filter circuit with the coil L1 and the capacitor C1. The smoothing circuit 560 coupled as described above smooths the amplified modulation signal Msa to be supplied to the coupling point between the transistors M1 and M2. Accordingly, the amplified modulation signal Msa is demodulated to generate the driving signal COM. Then, the generated driving signal COM is outputted from the terminal Out.

Note that, although not illustrated in FIG. 10, the driving circuit 50 may be configured to include a feedback circuit for feeding back the driving signal COM to be outputted. This makes it possible to suppress variations in characteristics of the driving circuit 50 and distortion in waveform.

4. Configuration of Circuit Board Mounted with Driving Circuit

Figure 11:
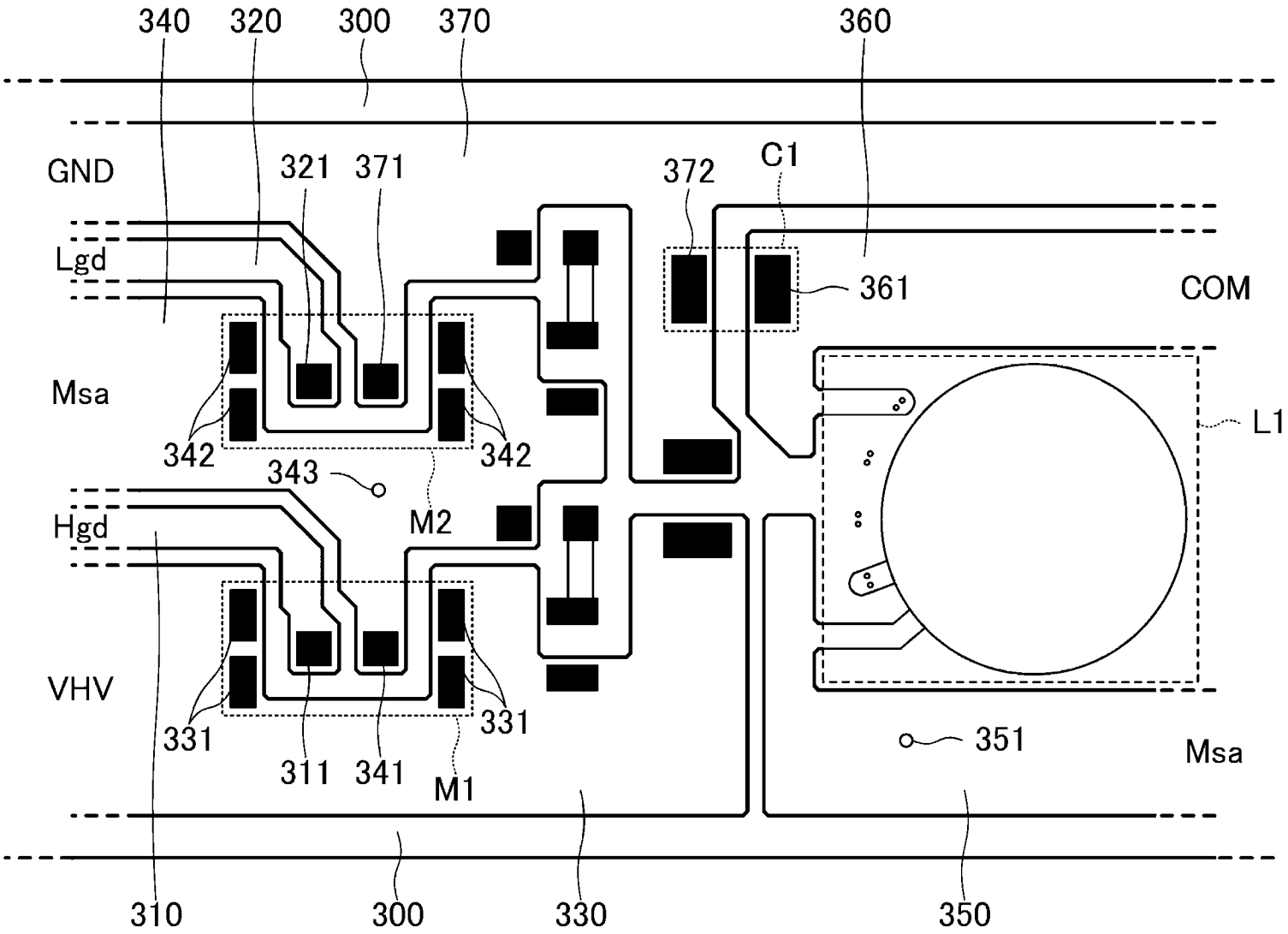
FIG. 11 is a diagram illustrating an example of a wiring layout of a circuit board.

Next, a configuration of a circuit board 300 on which the driving circuit 50 is mounted will be described with reference to FIG. 11. FIG. 11 is a diagram illustrating an example of a wiring layout of the circuit board 300 on which the driving circuit 50 is mounted. Note that, in FIG. 11, of the circuit board 300 on which the driving circuit 50 is mounted, a vicinity of a portion on which the amplifier circuit 570 and the smoothing circuit 560 illustrated in FIG. 10 are mounted is illustrated, and a portion on which the integrated circuit 500 is mounted is not illustrated.

As illustrated in FIG. 11, the circuit board 300 includes a plurality of wiring patterns including wiring 310, 320, 330, 340, 350, 360, and a plurality of electrodes provided on the plurality of wiring patterns.

The gate driving signal Hgd outputted from the terminal Hdr on the integrated circuit 500 illustrated in FIG. 10 is supplied to the wiring 310 via the resistor R1 not illustrated in FIG. 11. The gate driving signal Hgd propagated through the wiring 310 is inputted to a gate terminal of the transistor M1 via an electrode 311. Further, the gate driving signal Lgd outputted from the terminal Ldr on the integrated circuit 500 illustrated in FIG. 10 is supplied to the wiring 320 via the resistor R2 not illustrated in FIG. 11. The gate driving signal Lgd propagated through the wiring 320 is inputted to a gate terminal of the transistor M2 via an electrode 321. Further, the voltage VHV is supplied to the wiring 330. The voltage VHV propagated through the wiring 330 is inputted to a drain terminal of the transistor M1 via an electrode 331. Further, the ground signal is supplied to wiring 370. In addition, the ground signal propagated through the wiring 340 is inputted to a source terminal of the transistor M2 via an electrode 371. Further, the wiring 340 is coupling to a source terminal of the transistor M1 via an electrode 341, and is coupled to a drain terminal of the transistor M2 via an electrode 342. Then, the transistors M1 and M2 on the driving circuit 50 mounted on the circuit board 300 operate in accordance with the gate driving signals Hgd and Lgd, so that the amplified modulation signal Msa is supplied to the wiring 340.

A through-hole 343 is provided at the wiring 340. The through-hole 343 is coupled to a through-hole 351 provided at the wiring 350 via an inner layer wiring (not illustrated) provided in an inner layer of the circuit board 300. Thus, the amplified modulation signal Msa is supplied to the wiring 350.

The amplified modulation signal Msa supplied to the wiring 350 is propagated through the wiring 350, and is supplied to the coil L1. The amplified modulation signal Msa supplied to the coil L1 is outputted to the wiring 360. The capacitor C1 is coupled to the wiring 360 via an electrode 361. The capacitor C1 is also coupled to the wiring 370 via an electrode 372. Thus, the amplified modulation signal Msa is smoothed by the smoothing circuit 560 including the coil L1 and the capacitor C1. Thus, the driving signal COM is supplied to the wiring 360. Then, the driving signal COM supplied to the wiring 360 is outputted from the terminal Out not illustrated in FIG. 11.

5. Wiring Layout Forming Coil L1

In the circuit board described above on which the integrated circuit such as the driving circuit 50, that is the electric circuits including the various electronic components such as the transistor, the resistor, the capacitor, and the coil are mounted, a component height of the coil becomes larger than component heights of other electronic components in some cases. In addition, when the circuit board on which the coil having such a large component height is mounted is disposed in an electronic apparatus, space occupied by the circuit board in the electronic apparatus increases in accordance with the component height of the coil. Further, when differences between the component height of the coil and the component heights of the other electronic components are large, dead space in the space occupied by the circuit board increases. That is, in order to miniaturize and thin the electronic device, it is required to reduce the component height of the coil and to reduce component height differences between the coil and the various electronic components.

In the driving circuit 50 provided in the liquid discharging apparatus 1 illustrated in the present exemplary embodiment, when the number of the nozzles 651 driven by the driving signal COM outputted from the driving circuit 50 increases, an amount of electric current flowing through the coil L1 increases. In order to smooth such a large current, a component height of the coil L1 may become larger than component heights of the integrated circuit 500, the transistors M1, M2, and the capacitor C1. In addition, when component height differences between the coil L1, and the integrated circuit 500, the transistors M1, M2, and the capacitor C1 become large, the space occupied by the circuit board 300 on which the driving circuit 50 is mounted in the liquid discharging apparatus 1 increases. As a result, it becomes difficult to miniaturize the liquid discharging apparatus 1. Further, when the liquid discharging apparatus 1 is defined by a predetermined size, arrangement intervals narrow between various constituent elements constituting the liquid discharging apparatus 1 including the circuit board 300 on which the driving circuit 50 is mounted. As a result, heat, radiation noise, and the like generated in the respective constituent elements interfere with each other, so that stability of the operation of the liquid discharging apparatus 1 may decrease, deterioration in ink discharge accuracy may get worse, and the like.

Thus, in the present exemplary embodiment, in order to suppress an increase in the component height of the coil L1, at least a part of the coil L1 is constituted by a wiring pattern provided in the circuit board 300. Specifically, as illustrated in FIG. 12 to FIG. 17, the circuit board 300 includes a first layer 301 provided with wiring 111, a second layer 302 provided with wiring 121, a third layer 303 provided with wiring 131, and a fourth layer 304 provided with wiring 141. Further, the circuit board 300 is provided with a through-hole 161 electrically coupling the wiring 111 and the wiring 121, a through-hole 162 electrically coupling the wiring 121 and the wiring 131, and a through-hole 163 electrically coupling the wiring 131 and the wiring 141. In addition, the wiring 111, 121, 131, and 141 and the through-holes 161, 162, and 163 constitute at least a part of the coil L1. Note that, in the following description, a view of the circuit board 300 viewed from a direction orthogonal to the first layer 301 in the circuit board 300 will be referred to as a plan view. Further, although the circuit board 300 is described as having four wiring layers, that is, the first layer 301, the second layer 302, the third layer 303, and the fourth layer 304, it is sufficient that the circuit board has at least two wiring layers.

Figure 12:
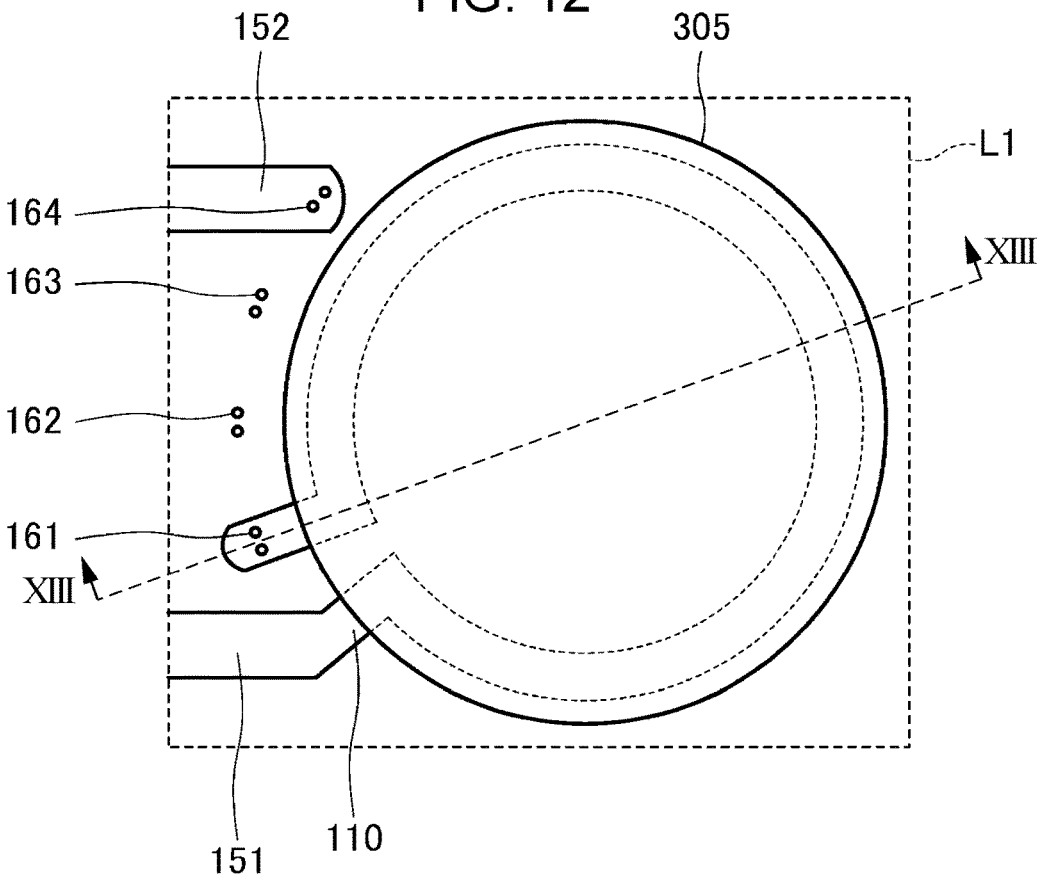
FIG. 12 is a plan view of a coil.
Figure 13:
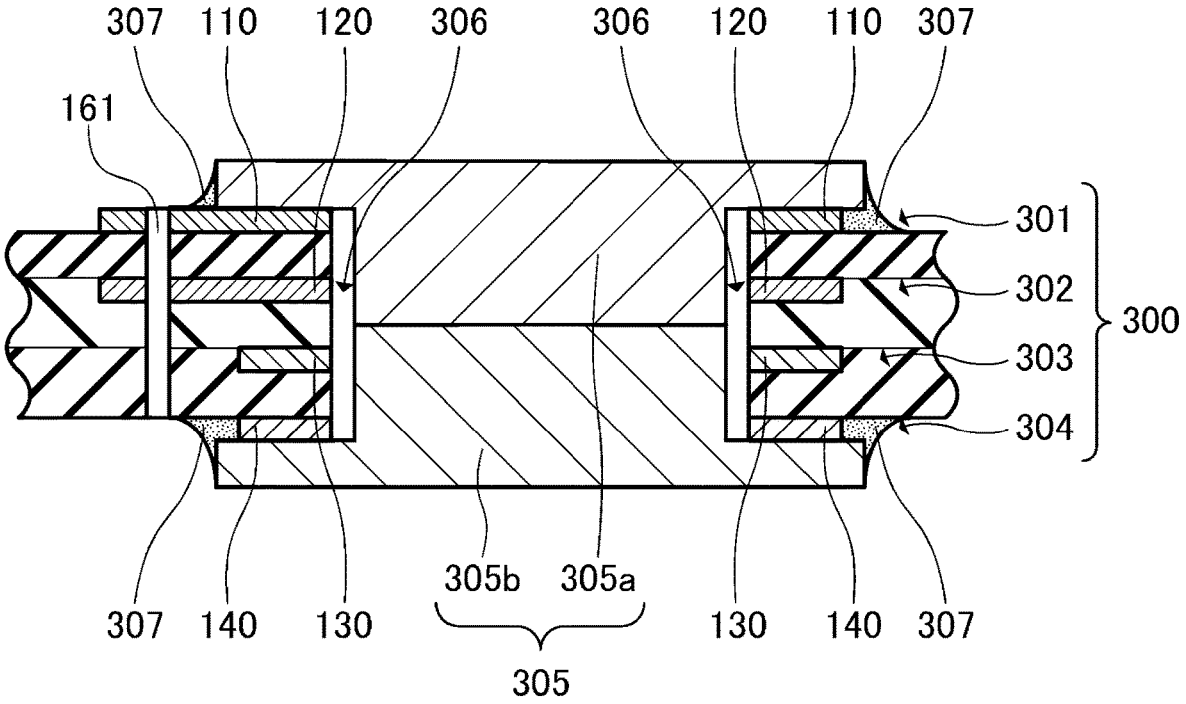
FIG. 13 is a sectional view of the coil taken along a line XIII-XIII illustrated in FIG. 12.

FIG. 12 is a plan view of the coil L1. In addition, FIG. 13 is a sectional view of the coil L1 illustrated in FIG. 12 taken along the line XIII-XIII. As illustrated in FIG. 12 and FIG. 13, the coil L1 according to the present exemplary embodiment includes a magnetic body 305, wiring 110, 120, 130, 140, 151, 152, and the through-holes 161, 162, 163, and a through-hole 164.

The magnetic body 305 is inserted into a through-hole 306 that passes through the circuit board 300. Specifically, the magnetic body 305 includes a first magnetic body 305*a* and a second magnetic body 305*b*. The first magnetic body 305*a* is inserted into the through-hole 306 from a surface of the circuit board 300 on a side of the first layer 301. In addition, the first magnetic body 305*a* is fixed to the circuit board 300 by an adhesive 307. Further, the second magnetic body 305*b* is inserted into the through-hole 306 from a surface of the circuit board 300 on a side of the fourth layer 304. In addition, the second magnetic body 305*b* is fixed to the circuit board 300 by the adhesive 307.

Pieces of the wiring 110, 120, 130, and 140 are provided in the first layer 301, second layer 302, third layer 303, and fourth layer 304 in the circuit board 300, respectively. As will be described in detail later, the wiring 110 is provided at the first layer 301 in the circuit board 300, and is provided in a circumferential shape so as to surround the through-hole 306. Further, the wiring 120 is provided at the second layer 302 in the circuit board 300, and is provided in a circumferential shape so as to surround the through-hole 306. Further, the wiring 130 is provided at the third layer 303 in the circuit board 300, and is provided in a circumferential shape so as to surround the through-hole 306. Further, the wiring 140 is provided at the fourth layer 304 in the circuit board 300, and is provided in a circumferential shape so as to surround the through-hole 306.

The through-holes 161, 162, 163, and 164 electrically couple each of the pieces of the wiring 110, 120, 130, and 140. As will be described in detail later, the through-hole 161 electrically couples the wiring 110 provided at the first layer 301 and the wiring 120 provided at the second layer 302. Further, the through-hole 162 electrically couples the wiring 120 provided at the second layer 302 and the wiring 130 provided at the third layer 303. Further, the through-hole 163 electrically couples the wiring 130 provided at the third layer 303 and the wiring 140 provided at the fourth layer 304. Further, the through-hole 164 electrically couples the wiring 140 provided at the fourth layer 304 and the wiring 152 provided at the first layer 301.

Here, the plurality of the through-holes 161 electrically coupling the wiring 110 provided at the first layer 301 and the wiring 120 provided at the second layer 302 may be provided, the plurality of the through-holes 162 electrically coupling the wiring 120 provided at the second layer 302 and the wiring 130 provided at the third layer 303 may be provided, the plurality of the through-holes 163 electrically coupling the wiring 130 provided at the third layer 303 and the wiring 140 provided at the fourth layer 304 may be provided, and the plurality of the through-holes 164 electrically coupling the wiring 140 provided at the fourth layer 304 and the wiring 152 provided at the first layer 301 may be provided. By coupling the first layer 301, the second layer 302, the third layer 303, and the fourth layer 304 with the plurality of through-holes 161, 162, 163, and 164, impedance generated in interlayers between the first layer 301, the second layer 302, the third layer 303, and the fourth layer 304 can be reduced. Thus, a possibility that the amplified modulation signal Msa is deteriorated due to a resistance component of the coil L1 is reduced. Thus, the amplified modulation signal Msa having a larger current can be stably supplied to the coil L1.

The wiring 151 couples the wiring 350 illustrated in FIG. 11 and the wiring 110. Further, the wiring 152 couples the wiring 360 illustrated in FIG. 11 and the through-hole 164.

In the coil L1 configured as described above, the amplified modulation signal Msa inputted from the wiring 350 via the wiring 151 is propagated through the wiring 110, 120, 130, and 140 provided in the circumferential shapes so as to surround the magnetic body 305 inserted into the through-hole 306. In addition, the amplified modulation signal Msa propagated through the coil L1 is outputted from the coil L1 to the wiring 360 via the wiring 152.

Here, the coil L1 may be configured not to include the magnetic body 305, but the magnetic body 305 is preferably provided in space inside the wiring 110, 120, 130, and 140 formed in the circumferential shapes as described above. By providing the magnetic body 305 in the space inside the wiring 110, 120, 130, and 140 formed in the circumferential shapes, magnetic flux generated by a current flowing through the wiring 110, 120, 130, and 140 is supplied to the magnetic body 305. This makes it possible to increase a relative dielectric constant of the coil L1, thereby making it possible to increase an inductance value of the coil L1. In other words, even when an area of the coil L1 formed in the circuit board 300 is reduced, the inductance value of the coil L1 can be obtained. Thus, it is possible to reduce the area in which the coil L1 is provided in the circuit board 300.

Furthermore, at least a part of the magnetic body 305 more preferably overlaps with the wiring 110 in plan view. Accordingly, more magnetic flux generated by a current flowing through the wiring 110 is supplied to the magnetic body 305. Thus, the relative dielectric constant of the coil L1 can be further increased, thereby making it possible to increase the inductance value of the coil L1. That is, the area in which the coil L1 is provided in the circuit board 300 can be further reduced.

Here, referring to FIG. 14 to FIG. 17, the wiring 110, 120, 130, and 140 formed on each of the first layer 301, second layer 302, third layer 303, and fourth layer 304 in the circuit board 300 will be described in detail.

Figure 14:
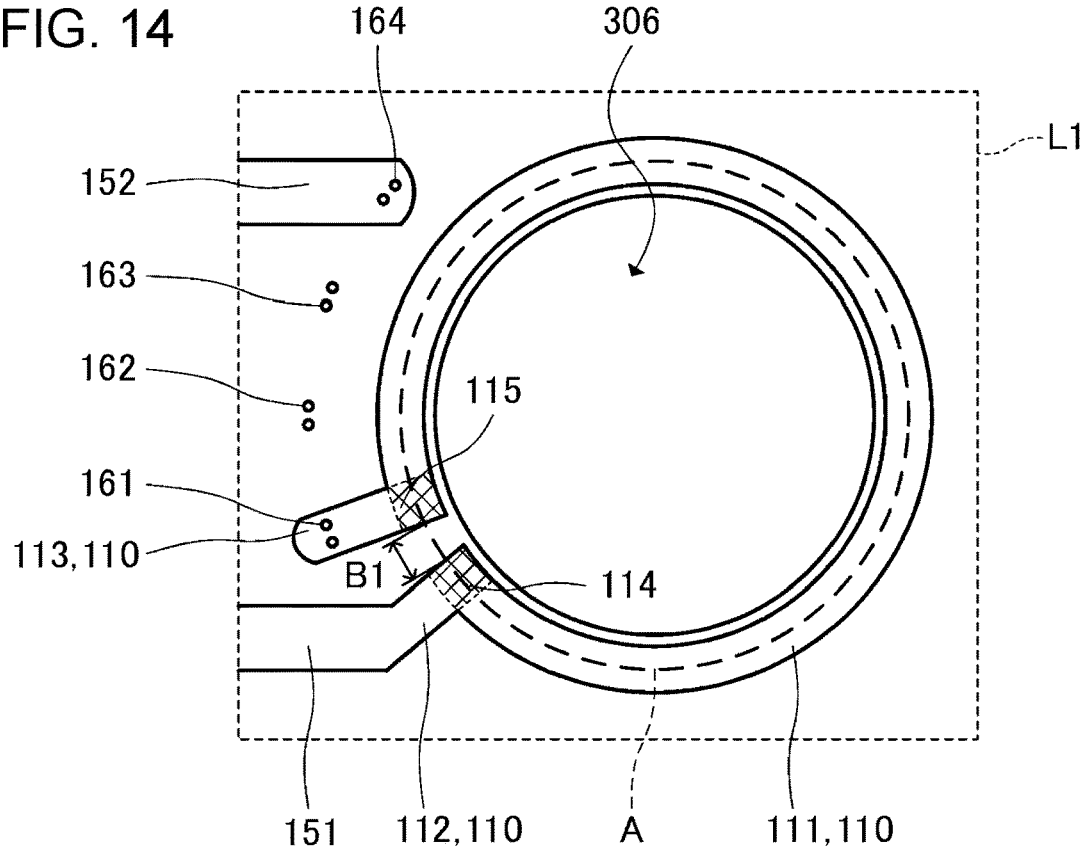
FIG. 14 is a diagram illustrating an example of a wiring pattern provided on a first layer.

FIG. 14 is a diagram illustrating an example of a wiring pattern provided on the first layer 301 in the circuit board 300. As illustrated in FIG. 14, the first layer 301 is provided with the wiring 111, 151, 152, wiring 112, 113, and the through-holes 161, 162, 163, and 164. Here, a wiring pattern including the wiring 111, 112, and 113 illustrated in FIG. 14 corresponds to the wiring 110 described above.

The wiring 111 couples a coupling point 114 and a coupling point 115 with the coupling point 114 as a start point and the coupling point 115 as an end point, and is provided in a circumferential shape on the first layer 301. Specifically, one end of the wiring 111 is coupled to one end of the wiring 112 at the coupling point 114. Another end of the wiring 111 is coupled to one end of the wiring 113 at the coupling point 115. Further, the wiring 111 is provided in the circumferential shape so as to surround the through-hole 306. The wiring 111 serves as a wiring pattern provided on the first layer 301 that directly contributes to the inductance value of the coil L1.

Here, the coupling point 114 and the coupling point 115 are provided at different positions on the first layer 301. That is, the wiring 111 couples the coupling point 114 and the coupling point 115 that are provided at the different positions. Specifically, when a virtual shape surrounding the through-hole 306 is defined as a virtual line A, the wiring 111 couples the coupling point 114 and the coupling point 115 in a counterclockwise direction in FIG. 14 along the virtual line A, with the coupling point 114 as the start point and the coupling point 115 as the end point. In this case, a gap B1 is generated in the counterclockwise direction in FIG. 14 along the virtual line A, with the coupling point 114 as a start point and the coupling point 115 as an end point. That is, the wiring 111 being provided in the circumferential shape means that a closed circumferential shape is formed by the wiring 111 and the gap B1.

Here, a wiring length of the wiring 111 is preferably larger than the gap B1. Setting the wiring length of the wiring 111 larger than the gap B1 makes it possible to extend the wiring length of the wiring 111 on the first layer 301. This makes it possible to further increase an inductance value caused by a current flowing through the wiring 111. Moreover, even when an area of the coil L1 formed on the first layer 301 is reduced, a sufficient inductance value can be obtained. Thus, it is possible to reduce the area in which the coil L1 is formed in the circuit board 300.

The wiring 112 couples the coupling point 114 and the wiring 151, and extends outward the wiring 111 formed in the circumferential shape. Specifically, one end of the wiring 112 is coupled to the coupling point 114. Further, another end of the wiring 112 is coupled to the wiring 151 provided outside the wiring 111 formed in the circumferential shape. That is, the wiring 112 couples the coupling point 114 and the wiring 151 in an area outside the wiring 111 formed in the circumferential shape. In other words, the wiring 112 is not formed in an area inside the wiring 111 formed in the circumferential shape.

The wiring 113 couples the coupling point 115 and the through-hole 161, and extends outward the wiring 111 formed in the circumferential shape. Specifically, one end of the wiring 113 is coupled to the coupling point 115. Further, another end of the wiring 113 is coupled to the through-hole 161 provided outside the wiring 111 formed in the circumferential shape. That is, the wiring 113 couples the coupling point 115 and the through-hole 161 in the area outside the wiring 111 formed in the circumferential shape. In other words, the wiring 113 is not formed in the area inside the wiring 111 formed in the circumferential shape.

By not providing the wiring 112 and 113 in the area inside the wiring 111 formed in the circumferential shape, a possibility that a signal propagated through the wiring 112 or 113 is superimposed on a signal propagated through the wiring 111 is reduced. Thus, it is possible to reduce a possibility that the inductance value generated due to the current flowing through the wiring 111 fluctuates.

As described above, on the first layer 301, the wiring 112 inputs the amplified modulation signal Msa inputted via the wiring 151 to the wiring 111, and the wiring 111 propagates the amplified modulation signal Msa. At this time, an inductance component of the coil L1 is generated due to a current generated by the amplified modulation signal Msa propagated through the wiring 111. Thereafter, the wiring 113 outputs the amplified modulation signal Msa outputted via the wiring 111 to the second layer 302 via the through-hole 161. Accordingly, at least a part of the coil L1 is formed on the first layer 301.

Note that, the wiring pattern provided on the first layer 301 is not coupled to the through-holes 162 and 163. Here, the wiring 111 is an example of first wiring, the coupling point 114 is an example of a first start point, and the coupling point 115 is an example of a first end point. Further, the wiring 113 coupling the coupling point 115 and the through-hole 161 is an example of third wiring.

Figure 15:
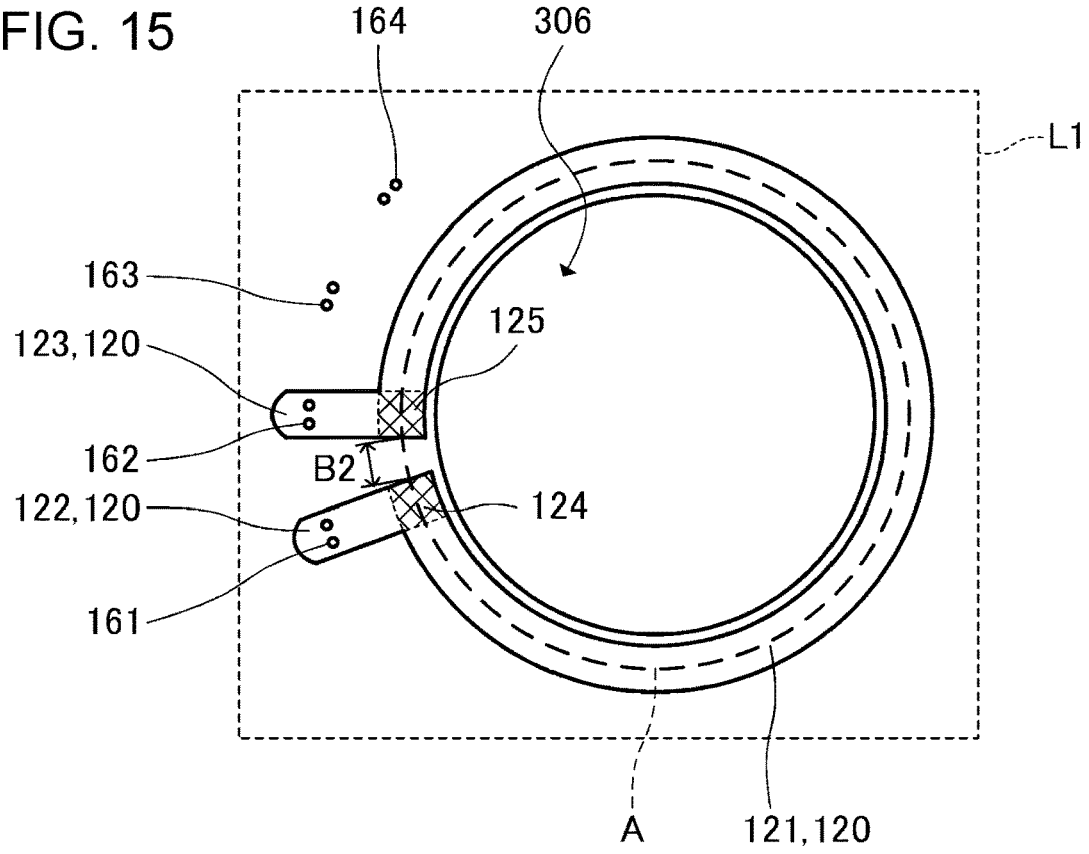
FIG. 15 is a diagram illustrating an example of a wiring pattern provided on a second layer.

FIG. 15 is a diagram illustrating an example of a wiring pattern provided on the second layer 302 in the circuit board 300. As illustrated in FIG. 15, the second layer 302 is provided with the wiring 121, and wiring 122 and 123, and the through-holes 161, 162, 163, and 164. Here, a wiring pattern including the wiring 121, 122, and 123 illustrated in FIG. 15 corresponds to the wiring 120 described above. Also, illustrated in FIG. 15 is the virtual line A illustrated in FIG. 14.

The wiring 121 couples a coupling point 124 and a coupling point 125 with the coupling point 124 as a start point and the coupling point 125 as an end point, and is provided in a circumferential shape on the second layer 302. Specifically, one end of the wiring 121 is coupled to one end of the wiring 122 at the coupling point 124. Another end of the wiring 121 is coupled to one end of the wiring 123 at the coupling point 125. Further, the wiring 121 is provided in the circumferential shape so as to surround the through-hole 306. The wiring 121 serves as a wiring pattern provided on the second layer 302 that directly contributes to the inductance value of the coil L1.

Here, the coupling point 124 and the coupling point 125 are provided at different positions on the second layer 302. That is, the wiring 121 couples the coupling point 124 and the coupling point 125 that are provided at the different positions. Specifically, the wiring 121 couples the coupling point 124 and the coupling point 125 in the counterclockwise direction in FIG. 15 along the virtual line A, with the coupling point 124 as the start point and the coupling point 125 as the end point. In this case, a gap B2 is generated in the counterclockwise direction in FIG. 15 along the virtual line A, with the coupling point 125 as a start point and the coupling point 124 as an end point. That is, the wiring 121 being provided in the circumferential shape means that a closed circumferential shape is formed by the wiring 121 and the gap B2.

Here, a wiring length of the wiring 121 is preferably larger than the gap B2. Setting the wiring length of the wiring 121 larger than the gap B2 makes it possible to extend the wiring length of the wiring 121 on the second layer 302. Thus, it is possible to increase an inductance value caused by a current flowing through the wiring 121. Moreover, even when an area of the coil L1 formed on the second layer 302 is reduced, a sufficient inductance value can be obtained. Thus, it is possible to reduce the area in which the coil L1 is formed in the circuit board 300.

The wiring 122 couples the coupling point 124 and the through-hole 161, and extends outward the wiring 121 formed in the circumferential shape. Specifically, one end of the wiring 122 is coupled to the coupling point 124. Further, another end of the wiring 122 is coupled to the through-hole 161 provided outside the wiring 121 formed in the circumferential shape. That is, the wiring 122 couples the coupling point 124 and the through-hole 161 in an area outside the wiring 121 formed in the circumferential shape. In other words, the wiring 122 is not formed in an area inside the wiring 121 formed in the circumferential shape.

The wiring 123 couples the coupling point 125 and the through-hole 162, and extends outward the wiring 121 formed in the circumferential shape. Specifically, one end of the wiring 123 is coupled to the coupling point 125. Further, another end of the wiring 123 is coupled to the through-hole 162 provided outside the wiring 121 formed in the circumferential shape. That is, the wiring 123 couples the coupling point 125 and the through-hole 162 in the area outside the wiring 121 formed in the circumferential shape. In other words, the wiring 123 is not formed in the area inside the wiring 121 formed in the circumferential shape.

By not providing the wiring 122 and 123 in the area inside the wiring 121 formed in the circumferential shape, a possibility that a signal propagated through the wiring 122 or 123 is superimposed on a signal propagated through the wiring 121 is reduced. Thus, it is possible to reduce a possibility that the inductance value generated due to the current flowing through the wiring 121 fluctuates.

As described above, on the second layer 302, the wiring 122 inputs the amplified modulation signal Msa inputted via the through-hole 161 to the wiring 121, and the wiring 121 propagates the amplified modulation signal Msa. At this time, an inductance component of the coil L1 is generated due to a current generated by the amplified modulation signal Msa propagated through the wiring 121. Thereafter, the wiring 123 outputs the amplified modulation signal Msa outputted via the wiring 121 to the third layer 303 via the through-hole 162. Accordingly, at least a part of the coil L1 is formed on the second layer 302.

Note that, the wiring pattern provided on the second layer 302 is not coupled to the through-holes 163 and 164. Here, the wiring 121 is an example of second wiring, the coupling point 124 is an example of a second start point, and the coupling point 125 is an example of a second end point. Further, the through-hole 161 electrically coupling the coupling point 115 on the first layer 301 and the coupling point 124 on the second layer 302 is an example of interlayer wiring. Further, the wiring 122 coupling the coupling point 124 and the through-hole 161 is an example of fourth wiring.

Figure 16:
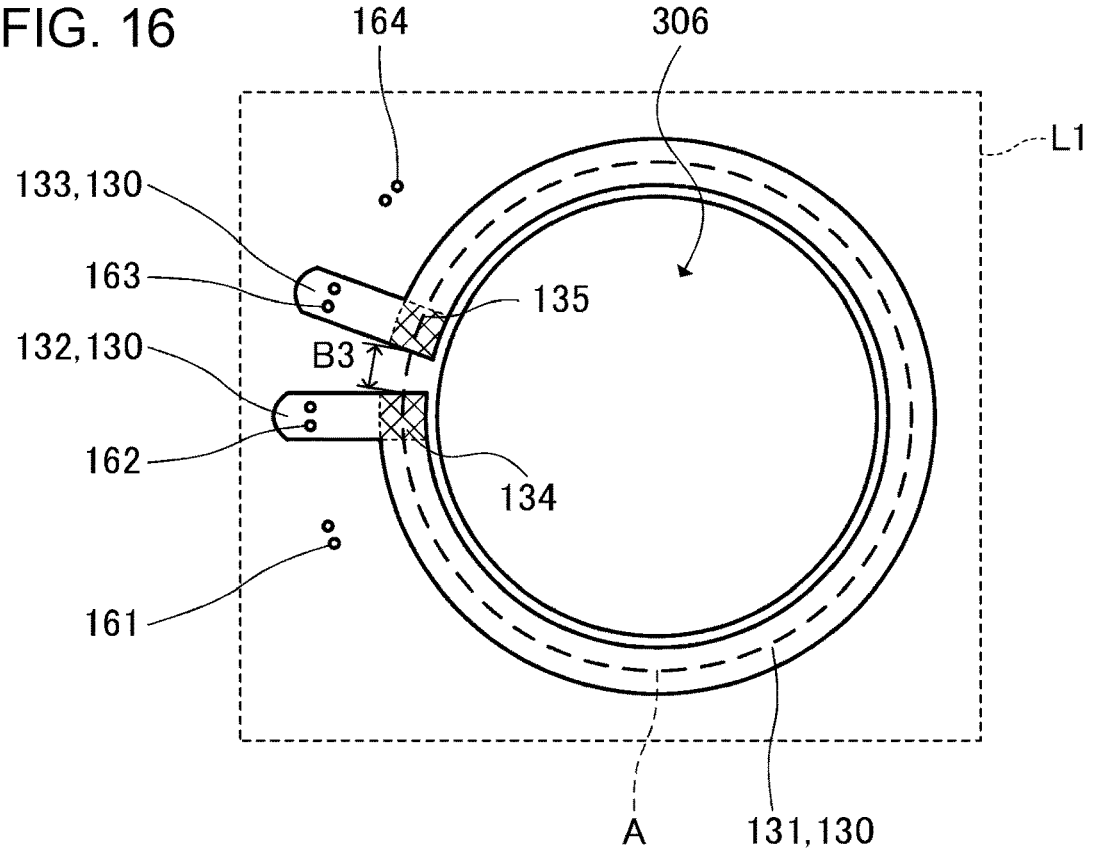
FIG. 16 is a diagram illustrating an example of a wiring pattern provided on a third layer.

FIG. 16 is a diagram illustrating an example of a wiring pattern provided on the third layer 303 in the circuit board 300. As illustrated in FIG. 16, the third layer 303 is provided with the wiring 131, and wiring 132 and 133, and the through-holes 161, 162, 163, and 164. Here, a wiring pattern including the wiring 131, 132, and 133 illustrated in FIG. 16 corresponds to the wiring 130 described above. Also, illustrated in FIG. 16 is the virtual line A illustrated in FIG. 14.

The wiring 131 couples a coupling point 134 and a coupling point 135 with the coupling point 134 as a start point and the coupling point 135 as an end point, and is provided in a circumferential shape on the third layer 303. Specifically, one end of the wiring 131 is coupled to one end of the wiring 132 at the coupling point 134. Another end of the wiring 131 is coupled to one end of the wiring 133 at the coupling point 135. Further, the wiring 131 is provided in the circumferential shape so as to surround the through-hole 306. The wiring 131 serves as a wiring pattern provided on the third layer 303 that directly contributes to the inductance value of the coil L1.

Here, the coupling point 134 and the coupling point 135 are provided at different positions on the third layer 303. That is, the wiring 131 couples the coupling point 134 and the coupling point 135 that are provided at the different positions. Specifically, the wiring 131 couples the coupling point 134 and the coupling point 135 in the counterclockwise direction in FIG. 16 along the virtual line A, with the coupling point 134 as the start point and the coupling point 135 as the end point. In this case, a gap B3 is generated in the counterclockwise direction in FIG. 16 along the virtual line A, with the coupling point 135 as a start point and the coupling point 134 as an end point. That is, the wiring 131 being provided in the circumferential shape means that a closed circumferential shape is formed by the wiring 131 and the gap B3.

Here, a wiring length of the wiring 131 is preferably larger than the gap B3. Setting the wiring length of the wiring 131 larger than the gap B3 makes it possible to extend the wiring length of the wiring 131 on the third layer 303. Thus, it is possible to increase an inductance value caused by a current flowing through the wiring 131. Moreover, even when an area of the coil L1 formed on the third layer 303 is reduced, a sufficient inductance value can be obtained. Thus, it is possible to reduce the area in which the coil L1 is formed in the circuit board 300.

The wiring 132 couples the coupling point 134 and the through-hole 162, and extends outward the wiring 131 formed in the circumferential shape. Specifically, one end of the wiring 132 is coupled to the coupling point 134. Further, another end of the wiring 132 is coupled to the through-hole 162 provided outside the wiring 131 formed in the circumferential shape. That is, the wiring 132 couples the coupling point 134 and the through-hole 162 in an area outside the wiring 131 formed in the circumferential shape. In other words, the wiring 132 is not formed in an area inside the wiring 131 formed in the circumferential shape.

The wiring 133 couples the coupling point 135 and the through-hole 163, and extends outward the wiring 131 formed in the circumferential shape. Specifically, one end of the wiring 133 is coupled to the coupling point 135. Further, another end of the wiring 133 is coupled to the through-hole 163 provided outside the wiring 131 formed in the circumferential shape. That is, the wiring 133 couples the coupling point 135 and the through-hole 163 in the area outside the wiring 131 formed in the circumferential shape. In other words, the wiring 133 is not formed in the area inside the wiring 131 formed in the circumferential shape.

By not providing the wiring 132 and 133 in the area inside the wiring 131 formed in the circumferential shape, a possibility that a signal propagated through the wiring 132 or 133 is superimposed on a signal propagated through the wiring 131 is reduced. Thus, it is possible to reduce a possibility that the inductance value generated due to the current flowing through the wiring 131 fluctuates.

As described above, on the third layer 303, the wiring 132 inputs the amplified modulation signal Msa inputted via the through-hole 162 to the wiring 131, and the wiring 131 propagates the amplified modulation signal Msa. At this time, an inductance component of the coil L1 is generated due to a current generated by the amplified modulation signal Msa propagated through the wiring 131. Thereafter, the wiring 133 outputs the amplified modulation signal Msa outputted via the wiring 131 to the fourth layer 304 via the through-hole 163. Accordingly, at least a part of the coil L1 is formed on the third layer 303.

Note that, the wiring pattern provided on the third layer 303 is not coupled to the through-holes 161 and 164.

Figure 17:
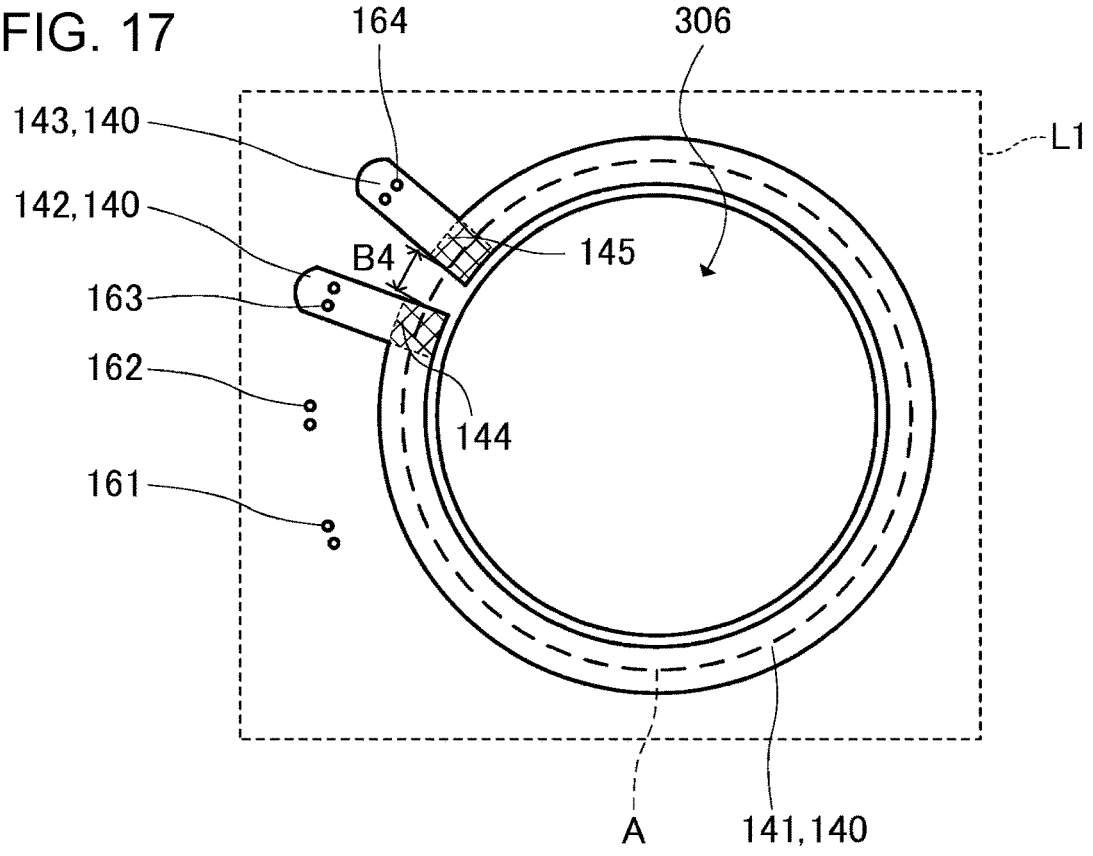
FIG. 17 is a diagram illustrating an example of a wiring pattern provided on a fourth layer.

FIG. 17 is a diagram illustrating an example of a wiring pattern provided on the fourth layer 304 in the circuit board 300. As illustrated in FIG. 17, the fourth layer 304 is provided with the wiring 141, and wiring 142 and 143, and the through-holes 161, 162, 163, and 164. Here, a wiring pattern including the wiring 141, 142, and 143 illustrated in FIG. 17 corresponds to the wiring 140 described above. Also, illustrated in FIG. 17 is the virtual line A illustrated in FIG. 14.

The wiring 141 couples a coupling point 144 and a coupling point 145 with the coupling point 144 as a start point and the coupling point 145 as an end point, and is provided in a circumferential shape on the fourth layer 304. Specifically, one end of the wiring 141 is coupled to one end of the wiring 142 at the coupling point 144. Another end of the wiring 141 is coupled to one end of the wiring 143 at the coupling point 145. Further, the wiring 141 is provided in the circumferential shape so as to surround the through-hole 306. The wiring 141 serves as a wiring pattern provided on the fourth layer 304 that directly contributes to the inductance value of the coil L1.

Here, the coupling point 144 and the coupling point 145 are provided at different positions on the fourth layer 304. That is, the wiring 141 couples the coupling point 144 and the coupling point 145 that are provided at the different positions. Specifically, the wiring 141 couples the coupling point 144 and the coupling point 145 in the counterclockwise direction in FIG. 17 along the virtual line A, with the coupling point 144 as the start point and the coupling point 145 as the end point. In this case, a gap B4 is generated in the counterclockwise direction in FIG. 17 along the virtual line A, with the coupling point 144 as a start point and the coupling point 145 as an end point. That is, the wiring 141 being provided in the circumferential shape means that a closed circumferential shape is formed by the wiring 141 and the gap B4.

Here, a wiring length of the wiring 141 is preferably larger than the gap B4. Setting the wiring length of the wiring 141 larger than the gap B4 makes it possible to extend the wiring length of the wiring 141 on the fourth layer 304. Thus, it is possible to increase an inductance value caused by a current flowing through the wiring 141. Moreover, even when an area of the coil L1 formed on the fourth layer 304 is reduced, a sufficient inductance value can be obtained. Thus, it is possible to reduce the area in which the coil L1 is formed in the circuit board 300.

The wiring 142 couples the coupling point 144 and the through-hole 163, and extends outward the wiring 141 formed in the circumferential shape. Specifically, one end of the wiring 142 is coupled to the coupling point 144. Further, another end of the wiring 142 is coupled to the through-hole 163 provided outside the wiring 141 formed in the circumferential shape. That is, the wiring 142 couples the coupling point 144 and the through-hole 163 in an area outside the wiring 141 formed in the circumferential shape. In other words, the wiring 142 is not formed in an area inside the wiring 141 formed in the circumferential shape.

The wiring 143 couples the coupling point 145 and the through-hole 164, and extends outward the wiring 141 formed in the circumferential shape. Specifically, one end of the wiring 143 is coupled to the coupling point 145. Further, another end of the wiring 143 is coupled to the through-hole 164 provided outside the wiring 141 formed in the circumferential shape. That is, the wiring 143 couples the coupling point 145 and the through-hole 164 in the area outside the wiring 141 formed in the circumferential shape. In other words, the wiring 143 is not formed in the area inside the wiring 141 formed in the circumferential shape.

By not providing the wiring 142 and 143 in the area inside the wiring 141 formed in the circumferential shape, a possibility that a signal propagated through the wiring 142 or 143 is superimposed on a signal propagated through the wiring 141 is reduced. Thus, it is possible to reduce a possibility that the inductance value generated due to the current flowing through the wiring 141 fluctuates.

As described above, on the fourth layer 304, the wiring 142 inputs the amplified modulation signal Msa inputted via the through-hole 163 to the wiring 141, and the wiring 141 propagates the amplified modulation signal Msa. At this time, an inductance component of the coil L1 is generated due to a current generated by the amplified modulation signal Msa propagated through the wiring 141. Thereafter, the wiring 143 outputs the amplified modulation signal Msa outputted via the wiring 141 to the first layer 301 via the through-hole 164. Accordingly, at least a part of the coil L1 is formed on the fourth layer 304.

Note that, the wiring pattern provided on the fourth layer 304 is not coupled to the through-holes 161 and 162.

As illustrated in FIG. 14, the through-hole 164 is coupled to the wiring 152 provided at the first layer 301. Further, the wiring 152 is coupled to the wiring 360 illustrated in FIG. 11. That is, the amplified modulation signal Msa is outputted from the coil L1 via the through-hole 164 and the wiring 152.

In the coil L1 configured as described above, the wiring 111 provided at the first layer 301, the wiring 121 provided at the second layer 302, the wiring 131 provided at the third layer 303, and the wiring 141 provided at the fourth layer 304 are provided so as to partially overlap each other in plan view. Specifically, as illustrated in FIG. 14 to FIG. 17, the wiring 111 provided at the first layer 301, the wiring 121 provided at the second layer 302, the wiring 131 provided at the third layer 303, and the wiring 141 provided at the fourth layer 304 are provided so as to partially overlap each other in plan view along the same virtual line A.

The inductance value of the coil L1 can be increased by providing the wiring 111 provided at the first layer 301, the wiring 121 provided at the second layer 302, the wiring 131 provided at the third layer 303, and the wiring 141 provided at the fourth layer 304 so as to overlap each other in plan view. Further, even when the area in which the coil L1 is configured is reduced, a sufficient inductance value can be obtained. Thus, it is possible to reduce the area in which the coil L1 is formed in the circuit board 300.

Further, a circumferential direction from the coupling point 114 toward the coupling point 115 of the wiring 111, a circumferential direction from the coupling point 124 toward the coupling point 125 of the wiring 121, a circumferential direction from the coupling point 134 toward the coupling point 135 of the wiring 131, and a circumferential direction from the coupling point 144 toward the coupling point 145 of the wiring 141 are more preferably the same direction.

As described above, the amplified modulation signal Msa is inputted to the first layer 301 constituting the coil L1 via the wiring 151. The amplified modulation signal Msa inputted to the first layer 301 is propagated from the coupling point 114 toward the coupling point 115 through the wiring 111, and then is outputted to the second layer 302 via the through-hole 161. That is, the current caused by the amplified modulation signal Msa propagated through the wiring 111 flows from the coupling point 114 toward the coupling point 115 through the wiring 111.

Similarly, the current caused by the amplified modulation signal Msa propagated through the wiring 121 flows from the coupling point 124 toward the coupling point 125 through the wiring 121, the current caused by the amplified modulation signal Msa propagated through the wiring 131 flows from the coupling point 134 toward the coupling point 135 through the wiring 131, and the current caused by the amplified modulation signal Msa propagated through the wiring 141 flows from the coupling point 144 toward the coupling point 145 through the wiring 141.

In the coil L1 constituted in the circuit board 300, by setting the circumferential direction from the coupling point 114 toward the coupling point 115 of the wiring 111, the circumferential direction from the coupling point 124 toward the coupling point 125 of the wiring 121, the circumferential direction from the coupling point 134 toward the coupling point 135 of the wiring 131, and the circumferential direction from the coupling point 144 toward the coupling point 145 of the wiring 141 to the same direction, the current flows in the same direction through the wiring 111, 121, 131, and 141, respectively. Thus, inductances generated due to the currents flowing through the respective wiring 111, 121, 131, and 141 superimpose each other. This makes it possible to further increase the inductance value of the coil L1. Further, even when the area in which the coil L1 is configured is reduced, a sufficient inductance value can be obtained. Thus, it is possible to reduce the area in which the coil L1 is formed in the circuit board 300.

Further, it is preferable that each of the wiring 113 and the wiring 122, the wiring 123 and the wiring 132, and the wiring 133 and the wiring 142 be preferably provided so as to at least partially overlap each other in plan view.

As illustrated in FIG. 14 to FIG. 17, each of the pieces of the wiring 113, 122, 123, 132, 133, and 142 couples each of the pieces of the wiring 111, 121, 131, and 141 directly contributing to the inductance value of the coil L1 in each of the first layer 301, the second layer 302, the third layer 303, and the fourth layer 304, and each of the through-holes 161, 162, 163, and 164 couples each of interlayers among the first layer 301, the second layer 302, the third layer 303, and the fourth layer 304. In other words, each of the pieces of the wiring 113, 122, 123, 132, 133, and 142 does not directly contribute to the inductance value of the coil L1.

In each of the pieces of the wiring 113, 122, 123, 132, 133, and 142 described above, the wiring 113 and the wiring 122 are provided so as to at least partially overlap each other, thus an inductance component generated by a current flowing through the wiring 113 and an inductance component generated by a current flowing through the wiring 122 can cancel each other out. Similarly, the wiring 123 and the wiring 132 are provided so as to at least partially overlap each other, thus an inductance component generated by a current flowing through the wiring 123 and an inductance component generated by a current flowing through the wiring 132 can cancel each other out. Similarly, the wiring 133 and the wiring 142 are provided so as to at least partially overlap each other, thus an inductance component generated by a current flowing through the wiring 133 and an inductance component generated by a current flowing through the wiring 142 can cancel each other out. This reduces a possibility that an inductance component that does not directly contribute to the inductance value of the coil L1 is generated. Thus, it is possible to reduce variation generated in the inductance value of the coil L1.

Further, the wiring 111, 121, 131, and 141 formed in the circumferential shapes may be a polygonal shape such as a quadrangle, a pentagon, or a hexagon, or a circumferential shape along a closed circumferential shape in which the polygonal shape and circular arcs are combined, but as illustrated in the present exemplary embodiment, each of the pieces of the wiring 111, 121, 131, and 141 is preferably the circular wiring. By setting each of the pieces of the wiring 111, 121, 131, and 141 to the circular shape, variation in current density in the each of the pieces of the wiring is reduced. Thus, variation in the inductance value due to the current based on the amplified modulation signal Msa is reduced. Thus, it is possible to reduce variation generated in the inductance value of the coil L1.

6. Functions and Effects

As described above, in the liquid discharging apparatus 1 in the present exemplary embodiment, at least a part of the coil L1 included in the smoothing circuit 560 in the driving circuit 50 is constituted by the wiring 111 provided in the circumferential shape on the first layer 301 in the circuit board 300, the wiring 121 provided in the circumferential shape on the second layer 302, and the through-hole 161. That is, at least a part of the coil L1 is constituted by a wiring pattern provided in the circuit board 300. Since the coil L1 is constituted by the wiring pattern provided in the circuit board 300 as described above, it is possible to suppress the increase in the component height of the coil L1.

Further, in the circuit board 300 used for the liquid discharging apparatus 1 in the present exemplary embodiment, the wiring 111 provided at the first layer 301 and constituting the part of the coil L1, and the wiring 121 provided at the second layer 302 and constituting the part of the coil L1 are provided so as to partially overlap each other in plan view. Accordingly, the inductance component generated by the current flowing through the wiring 111, and the inductance component generated by the current flowing through the wiring 121 are superimposed, so that the inductance value of the coil L1 that is at least partially constituted by the wiring 111 provided at the first layer 301, the wiring 121 provided at the second layer 302, and the through-hole 161 in the circuit board 300 can be increased. In other words, even when the area of the coil L1 formed in the circuit board 300 is reduced, a sufficient inductance value can be obtained. Accordingly, it is possible to reduce the area in which the coil L1 is formed in the circuit board 300.

As described above, in the liquid discharging apparatus 1 according to the present exemplary embodiment, by reducing the component height of the coil L1, it is possible to reduce the differences in height between the coil L1 and the other electronic components, and even when the circuit board 300 on which the driving circuit 50 is mounted is disposed in the liquid discharging apparatus 1, an increase in space occupied by the circuit board 300 is suppressed. Thus, a possibility that it is difficult to miniaturize the liquid discharging apparatus 1 is reduced.

Further, in the liquid discharging apparatus 1 according to the present exemplary embodiment, it is possible to reduce component height differences between the transistors M1 and M2, and the coil L1 that generate large heat, thus when a heat radiator for facilitating heat radiation for the transistors M1, M2 and the coil L1 is to be provided, it is possible to reduce time and effort required to process the heat radiator.

In addition, in the liquid discharging apparatus 1 according to the present exemplary embodiment, the through-hole 161 electrically coupling the wiring 111 provided at the first layer 301 and the wiring 121 provided at the second layer 302 is included. The through-hole 161 is electrically coupled to the wiring 111 via the wiring 113 on the first layer 301. Further, the through-hole 161 is electrically coupled to the wiring 121 via the wiring 122 on the second layer 302. The wiring 113 extends outward the wiring 111 provided in the circumferential shape, and the wiring 122 extends outward the wiring 121 provided in the circumferential shape. That is, the wiring 113 and the wiring 122 are not provided in the area inside the wiring 111 and 121. This reduces a possibility that a signal propagated through each of the pieces of the wiring 113 and 122 is superimposed on a signal propagated through the wiring 111 and a signal propagated through the wiring 121 respectively. Thus, it is possible to reduce a possibility that the inductance value generated due to the current flowing through the wiring 111 fluctuates.

7. Example of Applying Circuit Board to Electronic Device

The circuit board 300 described above can be applied to the liquid discharging apparatus 1 described above, and can also be applied to various electronic devices including coils. In the following description, a case will be described in which the circuit board 300 according to the present exemplary embodiment is applied to a portable device D including a smart phone 1000 for displaying an image, as an example of electronic devices.

Figure 18:
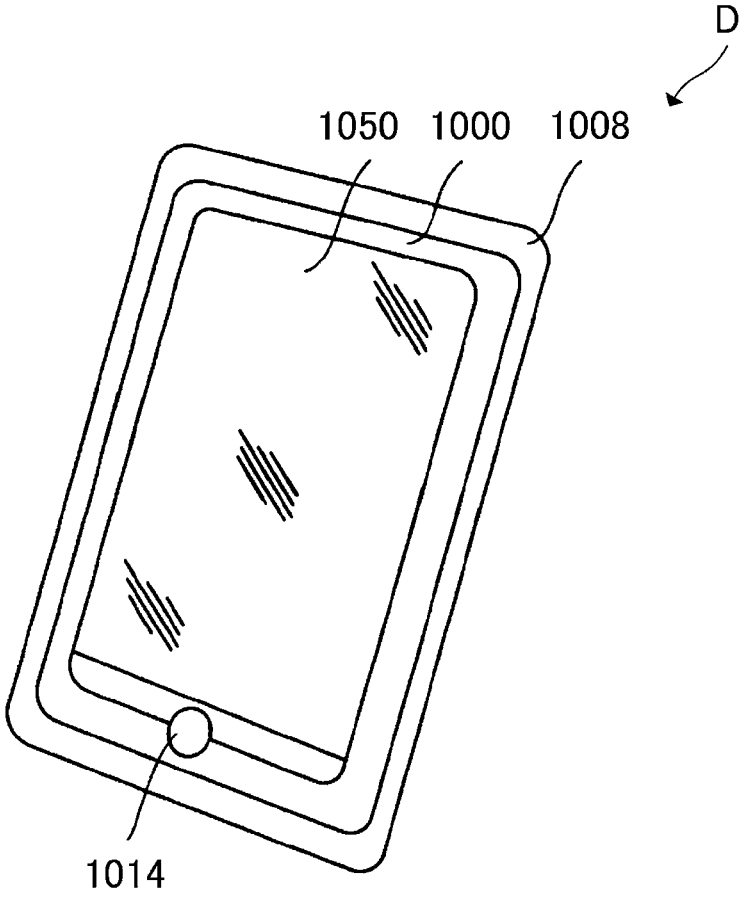
FIG. 18 is an external perspective view of a portable device viewed from a front side.

FIG. 18 is an external perspective view of the portable device D when viewed from a front side. The portable device D includes the smart phone 1000 and a mobile battery unit 1008 that is removable from the smart phone 1000.

The mobile battery unit 1008 is mounted on a back side of the smart phone 1000. As illustrated in FIG. 18, the mobile battery unit 1008 also functions as a cover for protecting the smart phone 1000.

The smart phone 1000 includes a display device 1050 and an operation section 1014. The display device 1050 displays various kinds of information relating to the smart phone 1000 and the mobile battery unit 1008. The display device 1050 is configured to include, for example, a display section such as a liquid crystal panel, an electronic paper panel, or an organic electroluminescence panel, and a control circuit for controlling the display section. The operation section 1014 accepts a user's operation.

Figure 19:
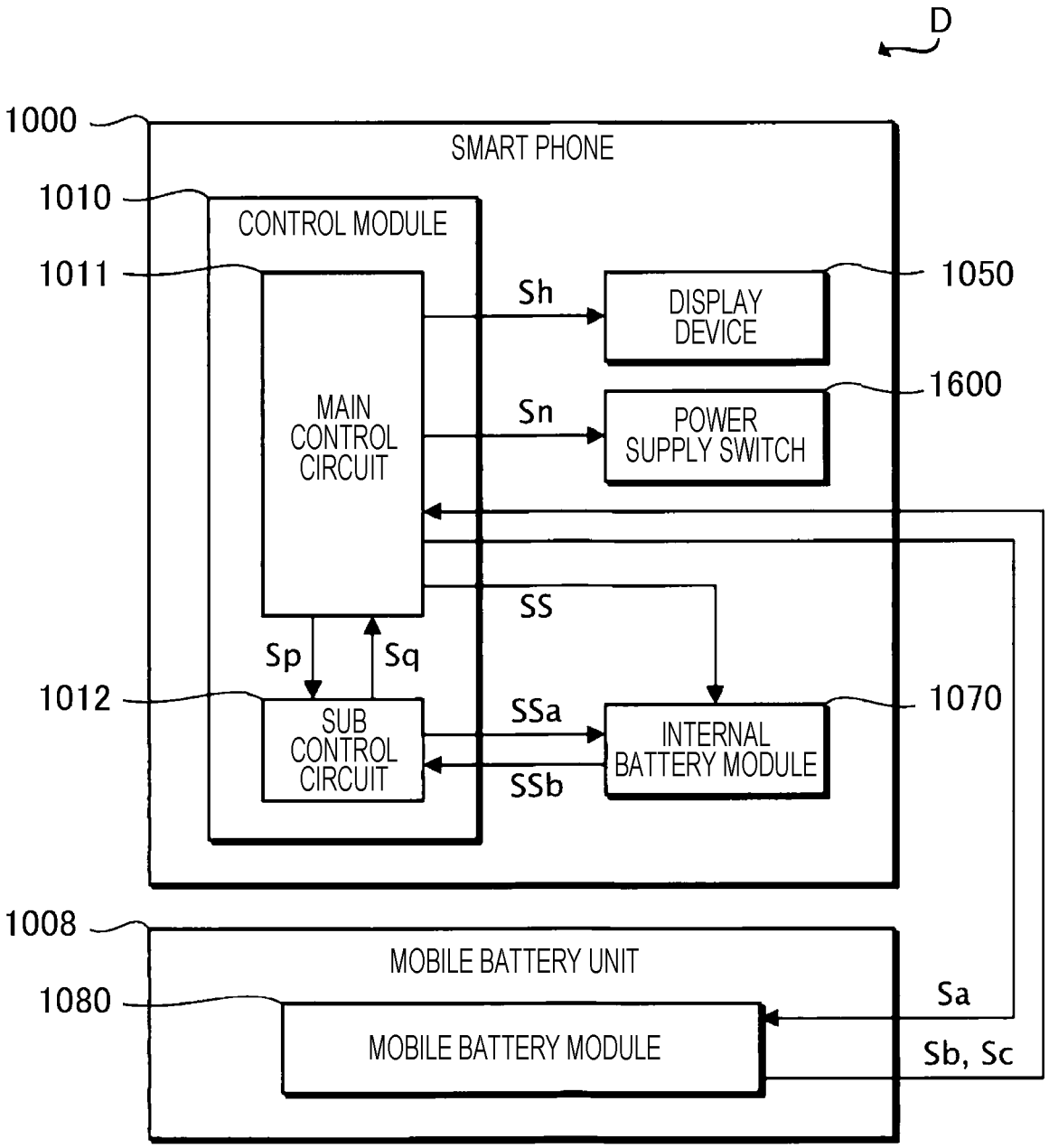
FIG. 19 is a functional block diagram illustrating an example of a functional configuration of the portable device.

FIG. 19 is a functional block diagram illustrating an example of a functional configuration of the portable device D. The portable device D includes the smart phone 1000 and the mobile battery unit 1008.

The smart phone 1000 includes a control module 1010 for controlling each section of the smart phone 1000, the display device 1050, an internal battery module 1070 capable of supplying power to each section of the smart phone 1000, and a power supply switch 1600 for switching whether or not the smart phone 1000 is supplied with electric power from the mobile battery unit 1008.

The mobile battery unit 1008 includes the mobile battery module 1080 capable of supplying power to each section of the smart phone 1000, when the mobile battery unit 1008 is mounted on the smart phone 1000.

In the present exemplary embodiment, as an example, it is assumed that the control module 1010 includes a main control circuit 1011 and a sub control circuit 1012.

The main control circuit 1011 is configured to include, for example, a CPU. Here, CPU is an abbreviation for Central Processing Unit. However, the main control circuit 1011 may include a DSP, an ASIC, a PLD, an FPGA, or the like, instead of the CPU or in addition to the CPU. Here, DSP is an abbreviation for Digital Signal Processor. ASIC is an abbreviation for Application Specific Integrated Circuit. PLD is an abbreviation for Programmable Logic Device. FPGA is an abbreviation for Field Programmable Gate Array.

The sub control circuit 1012 is configured to include, for example, a CPU. Note that, the sub control circuit 1012 may include a DSP, an ASIC, a PLD, an FPGA, or the like, instead of the CPU or in addition to the CPU.

The main control circuit 1011 supplies a display control signal Sh for controlling the display device 1050 to the display device 1050. In addition, the main control circuit 1011 supplies a specification signal Sn for specifying whether or not to turn on the power supply switch 1600 to the power supply switch 1600. Note that, when the power supply switch 1600 is turned on, the smart phone 1000 can receive power supplied from the mobile battery unit 1008 mounted on the smart phone 1000. Further, the main control circuit 1011 supplies a control signal SS for controlling the internal battery module 1070 to the internal battery module 1070. Further, the main control circuit 1011 supplies a control signal Sa for controlling the mobile battery module 1080 to the mobile battery module 1080. Also, the main control circuit 1011 acquires a state signal Sb indicating a state of the mobile battery unit 1008, and a mounting signal Sc indicating that the mobile battery unit 1008 is mounted on the smart phone 1000 from the mobile battery module 1080.

The sub control circuit 1012 supplies a control signal SSa for controlling the internal battery module 1070 to the internal battery module 1070. Further, the sub control circuit 1012 acquires a state signal SSb indicating a state of the internal battery module 1070 from the internal battery module 1070.

Note that, the main control circuit 1011 supplies an instruction signal Sp for instructing output of the control signal SSa to the sub control circuit 1012. Further, the main control circuit 1011 is supplied with a notification signal Sq for notifying of information stored in the sub control circuit 1012 from the sub control circuit 1012.

The internal battery module 1070 includes an internal battery (not illustrated). The internal battery can supply a power supply voltage to the control module 1010, the display device 1050, and the like. The internal battery module 1070 described above includes a booster circuit having a coil for converting a voltage outputted from the internal battery into a voltage value suitable for a power supply voltage for the control module 1010, the display device 1050, and the like, in some cases.

Further, the mobile battery module 1080 includes a mobile battery (not illustrated). The mobile battery, when the mobile battery unit 1008 is mounted on the smart phone 1000, and the power supply switch 1600 is turned on, can supply a power supply voltage to the control module 1010, the display device 1050, and the like. The mobile battery unit 1008 described above includes a booster circuit having a coil for converting a voltage outputted from the mobile battery into a voltage value suitable for a power supply voltage for the control module 1010, the display device 1050, and the like, in some cases.

As described above, by constituting at least a part of the coil included in the booster circuit included in the internal battery module 1070 by a wiring pattern in a circuit board on which the internal battery module 1070 is mounted, it is possible to suppress an increase in component height of the coil. Similarly, by constituting at least a part of the coil included in the booster circuit included in the mobile battery module 1080 by a wiring pattern in a circuit board on which the mobile battery module 1080 is mounted, it is possible to suppress an increase in component height of the coil.

In particular, for a portable electronic device such as the portable device D as described above, miniaturization and thinning are required. When the circuit board 300 illustrated in the present exemplary embodiment is applied to the above-described portable device D, the increase in component height of the coil is reduced, thus it is possible to further miniaturize and thin the portable device D.

Note that, the portable device D is illustrated and described as an example of the electronic devices in which the circuit board 300 in the present exemplary embodiment is used, but even when the circuit board 300 in the present exemplary embodiment is applied not only to the portable device D described above but also to various electronic devices, the same effect can also be achieved.

Although the exemplary embodiments and modifications have been described above, the present disclosure is not limited to the exemplary embodiments and modifications, and may be embodied in various forms without departing from the spirit and scope of the present disclosure. For example, the above-described exemplary embodiments may be combined as appropriate.

The present disclosure includes configurations substantially identical to those described in the present exemplary embodiments (for example, configurations having the same functions, methods and results, or configurations having the same purpose and effect). Further, the present disclosure includes a configuration in which a non-essential portion of the configuration described in the exemplary embodiments is replaced. Further, the present disclosure includes a configuration having the same functions and effects as those described in the exemplary embodiments, and a configuration capable of achieving the same purpose. Further, the present disclosure includes a configuration in which a known technique is added to the configuration described in the exemplary embodiments.

What is claimed is:

1. A liquid discharging apparatus, comprising:

a discharging head that includes a driving element configured to be driven by being supplied with a driving signal, and is configured to discharge liquid by the driving element being driven;

a driving circuit configured to generate the driving signal; and a circuit board, wherein the driving circuit includes a modulation circuit configured to generate a modulation signal obtained by performing pulse-modulation for a base driving signal serving as a base of the driving signal, an amplifier circuit configured to generate an amplified modulation signal obtained by amplifying the modulation signal, and a smoothing circuit including a coil and a capacitor, and configured to generate the driving signal obtained by smoothing the amplified modulation signal, the circuit board includes
a first layer,
a second layer,
first wiring provided at the first layer,
second wiring provided at the second layer, and
interlayer wiring,
the first wiring couples a first start point and a first end point, and is provided in a circumferential shape,
the second wiring couples a second start point and a second end point, and is provided in a circumferential shape,
the interlayer wiring electrically couples the first end point and the second start point,
the first wiring and the second wiring partially overlap each other, in plan view of the circuit board from a direction orthogonal to the first layer, and
the first wiring, the second wiring, and the interlayer wiring constitute at least a part of the coil.

2. The liquid discharging apparatus according to claim 1, wherein
a circumferential direction from the first start point toward the first end point of the first wiring, and
a circumferential direction from the second start point toward the second end point of the second wiring
are identical directions.

3. The liquid discharging apparatus according to claim 1, wherein
the circuit board includes
third wiring provided at the first layer, and
fourth wiring provided at the second layer,
the third wiring couples the first end point and the interlayer wiring, and extends outward the first wiring, and
the fourth wiring couples the second start point and the interlayer wiring, and extends outward the second wiring.

4. The liquid discharging apparatus according to claim 3, wherein
in the plan view, the third wiring and the fourth wiring are provided so as to partially overlap each other.

5. The liquid discharging apparatus according to claim 3, wherein
the third wiring and the fourth wiring are coupled to each other with plural pieces of interlayer wiring included by the circuit board.

6. The liquid discharging apparatus according to claim 1, wherein
the first wiring is circular wiring.

7. The liquid discharging apparatus according to claim 1, wherein
a magnetic body is provided in an area inside the first wiring.

8. The liquid discharging apparatus according to claim 7, wherein
in the plan view, at least a part of the magnetic body overlaps with the first wiring.

9. A circuit board, comprising:
a first layer;
a second layer;
first wiring provided at the first layer;
second wiring provided at the second layer;
third wiring provided at the first layer;
fourth wiring provided at the second layer; and
interlayer wiring, wherein
the first wiring couples a first start point and a first end point, and is provided in a circumferential shape,
the second wiring couples a second start point and a second end point, and is provided in a circumferential shape,
the third wiring couples the first end point and the interlayer wiring, and extends outward the first wiring,
the fourth wiring couples the second start point and the interlayer wiring, and extends outward the second wiring,
the interlayer wiring electrically couples the first end point and the second start point,
the first wiring and the second wiring partially overlap each other in plan view from a direction orthogonal to the first layer, and
the first wiring, the second wiring, and the interlayer wiring constitute at least a part of a coil.

10. The circuit board according to claim 9, wherein
a circumferential direction from the first start point toward the first end point of the first wiring, and
a circumferential direction from the second start point toward the second end point of the second wiring
are identical directions.

11. The circuit board according to claim 9, wherein
in the plan view, the third wiring and the fourth wiring are provided so as to partially overlap each other.

12. The circuit board according to claim 9, wherein
the third wiring and the fourth wiring are coupled to each other with plural pieces of interlayer wiring included by the circuit board.

13. The circuit board according to claim 9, wherein
the first wiring is provided in a circular shape.

* * * * *